US009024852B2

(12) United States Patent
Ishihara

(10) Patent No.: US 9,024,852 B2
(45) Date of Patent: May 5, 2015

(54) IMAGE DISPLAYING METHOD AND IMAGE DISPLAYING APPARATUS

(75) Inventor: Tomoyuki Ishihara, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 518 days.

(21) Appl. No.: 13/490,898

(22) Filed: Jun. 7, 2012

(65) Prior Publication Data

US 2013/0057772 A1 Mar. 7, 2013

Related U.S. Application Data

(60) Division of application No. 12/072,000, filed on Feb. 28, 2008, now Pat. No. 8,223,098, which is a continuation-in-part of application No. PCT/JP2006/320111, filed on Oct. 6, 2006.

(30) Foreign Application Priority Data

Nov. 7, 2005 (JP) ..... 2005-322685

(51) Int. Cl.
*G09G 3/36* (2006.01)
*G09G 3/20* (2006.01)

(52) U.S. Cl.
CPC ..... *G09G 3/3611* (2013.01); *G09G 3/2011* (2013.01); *G09G 3/2018* (2013.01); *G09G 3/2025* (2013.01); *G09G 2320/0261* (2013.01); *G09G 2340/0435* (2013.01)

(58) Field of Classification Search
CPC . G09G 3/2022; G09G 3/2025; G09G 3/2029; G09G 3/2033; G09G 2/2037; G09G 2/204; G09G 2340/16
USPC ..... 345/87–104, 204
See application file for complete search history.

(56) References Cited

U.S. PATENT DOCUMENTS 6,466,225 B1 10/2002 Larkin et al.
6,529,204 B1 * 3/2003 Mikoshiba et al. ..... 345/597
(Continued)

FOREIGN PATENT DOCUMENTS

EP 1 536 407 6/2005
JP 2000-029442 1/2000
(Continued)

OTHER PUBLICATIONS

PCT/ISA/210.
(Continued)

*Primary Examiner* — Alexander Eisen
*Assistant Examiner* — Nelson Lam
(74) *Attorney, Agent, or Firm* — Harness, Dickey & Pierce, P.L.C.

(57) ABSTRACT

An image displaying apparatus divides 1 frame into plural sub-frame periods, and modifies the image signals in which a region denoted by an image signal α or an image signal close to the image signal α and a region of another image signal β or an image signal close to the image signal β are adjacent to each other. The image displaying apparatus carries out display, in at least one sub-frames period A, with a modified image signal so that the difference with the image signal of the other region becomes smaller, and in at least one other sub-frames period B, with a modified image signal so that the difference with the image signal of the other region becomes more significant, in the vicinity of the boundary between the region of the image signal α and the region of the image signal β.

23 Claims, 40 Drawing Sheets

(56) References Cited

U.S. PATENT DOCUMENTS

| | | | | |
|---|---|---|---|---|
| 7,483,084 | B2 | 1/2009 | Kawamura et al. | |
| 7,990,358 | B2 * | 8/2011 | Ishihara | 345/99 |
| 8,223,098 | B2 * | 7/2012 | Ishihara | 345/88 |
| 8,363,071 | B2 * | 1/2013 | Kondo et al. | 345/691 |
| 8,902,319 | B2 * | 12/2014 | Ishihara | 348/208.4 |
| 2002/0003520 | A1 | 1/2002 | Aoki | |
| 2003/0011614 | A1 | 1/2003 | Itoh et al. | |
| 2003/0058229 | A1 | 3/2003 | Kawabe et al. | |
| 2004/0130560 | A1 | 7/2004 | Matsueda et al. | |
| 2004/0257325 | A1 | 12/2004 | Inoue | |
| 2005/0156843 | A1 | 7/2005 | Itoh et al. | |
| 2005/0162360 | A1 | 7/2005 | Ishihara et al. | |
| 2005/0206643 | A1 | 9/2005 | Endoh et al. | |
| 2005/0253785 | A1 | 11/2005 | Miyasaka et al. | |
| 2006/0197732 | A1 | 9/2006 | Oyaizu et al. | |
| 2008/0170026 | A1 | 7/2008 | Ishihara | |
| 2009/0213050 | A1 * | 8/2009 | Hung | 345/87 |
| 2010/0118044 | A1 * | 5/2010 | Ishihara | 345/589 |
| 2010/0156772 | A1 * | 6/2010 | Arashima et al. | 345/87 |
| 2011/0128449 | A1 * | 6/2011 | Ishihara | 348/701 |
| 2011/0292068 | A1 * | 12/2011 | Kobayashi | 345/589 |

FOREIGN PATENT DOCUMENTS

| | | |
|---|---|---|
| JP | 2001-296841 | 10/2001 |
| JP | 2002-023707 | 1/2002 |
| JP | 3295437 | 4/2002 |
| JP | 2003-022061 | 1/2003 |
| JP | 2005-173387 | 6/2005 |
| JP | 2005-173573 | 6/2005 |
| WO | WO00/67248 | 11/2000 |

OTHER PUBLICATIONS

Supplemental European Search Report dated Apr. 17, 2009.

European Search Report dated May 25, 2010.

European Office Action dated Mar. 2, 2011.

U.S. Restriction Requirement dated May 25, 2011 for U.S. Appl. No. 12/072,000.

U.S. Office Action dated Sep. 29, 2011 for U.S. Appl. No. 12/072,000.

U.S. Notice of Allowance dated Mar. 15, 2012 for U.S. Appl. No. 12/072,000.

* cited by examiner

FIG. 3

| | | | | | | | | | | | | | | | | | | | | | | |
|---|---|---|---|---|---|---|---|---|---|---|---|---|---|---|---|---|---|---|---|---|---|---|
| 25 | 25 | 25 | 25 | 25 | 25 | 25 | 25 | 25 | 25 | 25 | 25 | 75 | 75 | 75 | 75 | 75 | 75 | 75 | 75 | 75 | 75 | 75 |
| 25 | 25 | 25 | 25 | 25 | 25 | 25 | 25 | 25 | 25 | 25 | 25 | 75 | 75 | 75 | 75 | 75 | 75 | 75 | 75 | 75 | 75 | 75 |
| 25 | 25 | 25 | 25 | 25 | 25 | 25 | 25 | 25 | 25 | 25 | 25 | 75 | 75 | 75 | 75 | 75 | 75 | 75 | 75 | 75 | 75 | 75 |
| 25 | 25 | 25 | 25 | 25 | 25 | 25 | 25 | 25 | 25 | 25 | 25 | 75 | 75 | 75 | 75 | 75 | 75 | 75 | 75 | 75 | 75 | 75 |
| 25 | 25 | 25 | 25 | 25 | 25 | 25 | 25 | 25 | 25 | 25 | 25 | 75 | 75 | 75 | 75 | 75 | 75 | 75 | 75 | 75 | 75 | 75 |
| 25 | 25 | 25 | 25 | 25 | 25 | 25 | 25 | 25 | 25 | 25 | 25 | 75 | 75 | 75 | 75 | 75 | 75 | 75 | 75 | 75 | 75 | 75 |
| 25 | 25 | 25 | 25 | 25 | 25 | 25 | 25 | 25 | 25 | 25 | 25 | 75 | 75 | 75 | 75 | 75 | 75 | 75 | 75 | 75 | 75 | 75 |
| 25 | 25 | 25 | 25 | 25 | 25 | 25 | 25 | 25 | 25 | 25 | 25 | 75 | 75 | 75 | 75 | 75 | 75 | 75 | 75 | 75 | 75 | 75 |
| 25 | 25 | 25 | 25 | 25 | 25 | 25 | 25 | 25 | 25 | 25 | 25 | 75 | 75 | 75 | 75 | 75 | 75 | 75 | 75 | 75 | 75 | 75 |
| 25 | 25 | 25 | 25 | 25 | 25 | 25 | 25 | 25 | 25 | 25 | 25 | 75 | 75 | 75 | 75 | 75 | 75 | 75 | 75 | 75 | 75 | 75 |
| 25 | 25 | 25 | 25 | 25 | 25 | 25 | 25 | 25 | 25 | 25 | 25 | 75 | 75 | 75 | 75 | 75 | 75 | 75 | 75 | 75 | 75 | 75 |
| 25 | 25 | 25 | 25 | 25 | 25 | 25 | 25 | 25 | 25 | 25 | 25 | 75 | 75 | 75 | 75 | 75 | 75 | 75 | 75 | 75 | 75 | 75 |
| 25 | 25 | 25 | 25 | 25 | 25 | 25 | 25 | 25 | 25 | 25 | 25 | 75 | 75 | 75 | 75 | 75 | 75 | 75 | 75 | 75 | 75 | 75 |
| 25 | 25 | 25 | 25 | 25 | 25 | 25 | 25 | 25 | 25 | 25 | 25 | 75 | 75 | 75 | 75 | 75 | 75 | 75 | 75 | 75 | 75 | 75 |
| 25 | 25 | 25 | 25 | 25 | 25 | 25 | 25 | 25 | 25 | 25 | 25 | 75 | 75 | 75 | 75 | 75 | 75 | 75 | 75 | 75 | 75 | 75 |
| 25 | 25 | 25 | 25 | 25 | 25 | 25 | 25 | 25 | 25 | 25 | 25 | 75 | 75 | 75 | 75 | 75 | 75 | 75 | 75 | 75 | 75 | 75 |
| 25 | 25 | 25 | 25 | 25 | 25 | 25 | 25 | 25 | 25 | 25 | 25 | 75 | 75 | 75 | 75 | 75 | 75 | 75 | 75 | 75 | 75 | 75 |
| 25 | 25 | 25 | 25 | 25 | 25 | 25 | 25 | 25 | 25 | 25 | 25 | 75 | 75 | 75 | 75 | 75 | 75 | 75 | 75 | 75 | 75 | 75 |
| 25 | 25 | 25 | 25 | 25 | 25 | 25 | 25 | 25 | 25 | 25 | 25 | 75 | 75 | 75 | 75 | 75 | 75 | 75 | 75 | 75 | 75 | 75 |
| 25 | 25 | 25 | 25 | 25 | 25 | 25 | 25 | 25 | 25 | 25 | 25 | 75 | 75 | 75 | 75 | 75 | 75 | 75 | 75 | 75 | 75 | 75 |
| 25 | 25 | 25 | 25 | 25 | 25 | 25 | 25 | 25 | 25 | 25 | 25 | 75 | 75 | 75 | 75 | 75 | 75 | 75 | 75 | 75 | 75 | 75 |

FIG. 4

| | | | | | | | | | | | | | | | | | | | | | | | |
|---|---|---|---|---|---|---|---|---|---|---|---|---|---|---|---|---|---|---|---|---|---|---|---|
| 25 | 25 | 25 | 25 | 25 | 25 | 25 | 25 | 25 | 25 | 25 | 25 | 75 | 75 | 75 | 75 | 75 | 75 | 75 | 75 | 75 | 75 | 75 | 75 |
| 25 | 25 | 25 | 25 | 25 | 25 | 25 | 25 | 25 | 25 | 25 | 25 | 75 | 75 | 75 | 75 | 75 | 75 | 75 | 75 | 75 | 75 | 75 | 75 |
| 25 | 25 | 25 | 25 | 25 | 25 | 25 | 25 | 25 | 25 | 25 | 25 | 75 | 75 | 75 | 75 | 75 | 75 | 75 | 75 | 75 | 75 | 75 | 75 |
| 25 | 25 | 25 | 25 | 25 | 25 | 25 | 25 | 25 | 25 | 25 | 25 | 75 | 75 | 75 | 75 | 75 | 75 | 75 | 75 | 75 | 75 | 75 | 75 |
| 25 | 25 | 25 | 25 | 25 | 25 | 25 | 25 | 25 | 25 | 25 | 25 | 75 | 75 | 75 | 75 | 75 | 75 | 75 | 75 | 75 | 75 | 75 | 75 |
| 25 | 25 | 25 | 25 | 25 | 25 | 25 | 25 | 25 | 25 | 25 | 25 | 75 | 75 | 75 | 75 | 75 | 75 | 75 | 75 | 75 | 75 | 75 | 75 |
| 25 | 25 | 25 | 25 | 25 | 25 | 25 | 25 | 25 | 25 | 25 | 25 | 75 | 75 | 75 | 75 | 75 | 75 | 75 | 75 | 75 | 75 | 75 | 75 |
| 25 | 25 | 25 | 25 | 25 | 25 | 25 | 25 | 25 | 25 | 25 | 25 | 75 | 75 | 75 | 75 | 75 | 75 | 75 | 75 | 75 | 75 | 75 | 75 |
| 25 | 25 | 25 | 25 | 25 | 25 | 25 | 25 | 25 | 25 | 25 | 25 | 75 | 75 | 75 | 75 | 75 | 75 | 75 | 75 | 75 | 75 | 75 | 75 |
| 25 | 25 | 25 | 25 | 25 | 25 | 25 | 25 | 25 | 25 | 25 | 25 | 75 | 75 | 75 | 75 | 75 | 75 | 75 | 75 | 75 | 75 | 75 | 75 |
| 25 | 25 | 25 | 25 | 25 | 25 | 25 | 25 | 25 | 25 | 25 | 25 | 75 | 75 | 75 | 75 | 75 | 75 | 75 | 75 | 75 | 75 | 75 | 75 |
| 25 | 25 | 25 | 25 | 25 | 25 | 25 | 25 | 25 | 25 | 25 | 25 | 75 | 75 | 75 | 75 | 75 | 75 | 75 | 75 | 75 | 75 | 75 | 75 |
| 25 | 25 | 25 | 25 | 25 | 25 | 25 | 25 | 25 | 25 | 25 | 25 | 75 | 75 | 75 | 75 | 75 | 75 | 75 | 75 | 75 | 75 | 75 | 75 |
| 25 | 25 | 25 | 25 | 25 | 25 | 25 | 25 | 25 | 25 | 25 | 25 | 75 | 75 | 75 | 75 | 75 | 75 | 75 | 75 | 75 | 75 | 75 | 75 |
| 25 | 25 | 25 | 25 | 25 | 25 | 25 | 25 | 25 | 25 | 25 | 25 | 75 | 75 | 75 | 75 | 75 | 75 | 75 | 75 | 75 | 75 | 75 | 75 |
| 25 | 25 | 25 | 25 | 25 | 25 | 25 | 25 | 25 | 25 | 25 | 25 | 75 | 75 | 75 | 75 | 75 | 75 | 75 | 75 | 75 | 75 | 75 | 75 |
| 25 | 25 | 25 | 25 | 25 | 25 | 25 | 25 | 25 | 25 | 25 | 25 | 75 | 75 | 75 | 75 | 75 | 75 | 75 | 75 | 75 | 75 | 75 | 75 |
| 25 | 25 | 25 | 25 | 25 | 25 | 25 | 25 | 25 | 25 | 25 | 25 | 75 | 75 | 75 | 75 | 75 | 75 | 75 | 75 | 75 | 75 | 75 | 75 |
| 25 | 25 | 25 | 25 | 25 | 25 | 25 | 25 | 25 | 25 | 25 | 25 | 75 | 75 | 75 | 75 | 75 | 75 | 75 | 75 | 75 | 75 | 75 | 75 |
| 25 | 25 | 25 | 25 | 25 | 25 | 25 | 25 | 25 | 25 | 25 | 25 | 75 | 75 | 75 | 75 | 75 | 75 | 75 | 75 | 75 | 75 | 75 | 75 |
| 25 | 25 | 25 | 25 | 25 | 25 | 25 | 25 | 25 | 25 | 25 | 25 | 75 | 75 | 75 | 75 | 75 | 75 | 75 | 75 | 75 | 75 | 75 | 75 |
| 25 | 25 | 25 | 25 | 25 | 25 | 25 | 25 | 25 | 25 | 25 | 25 | 75 | 75 | 75 | 75 | 75 | 75 | 75 | 75 | 75 | 75 | 75 | 75 |

FIG. 5

| | | | | | | | | | | | | | | | | | | | | | | | |
|---|---|---|---|---|---|---|---|---|---|---|---|---|---|---|---|---|---|---|---|---|---|---|---|
| 25 | 25 | 25 | 25 | 25 | 25 | 25 | 25 | 25 | 25 | 25 | 25 | 75 | 75 | 75 | 75 | 75 | 75 | 75 | 75 | 75 | 75 | 75 | 75 |
| 25 | 25 | 25 | 25 | 25 | 25 | 25 | 25 | 25 | 25 | 25 | 25 | 75 | 75 | 75 | 75 | 75 | 75 | 75 | 75 | 75 | 75 | 75 | 75 |
| 25 | 25 | 25 | 25 | 25 | 25 | 25 | 25 | 25 | 25 | 25 | 25 | 75 | 75 | 75 | 75 | 75 | 75 | 75 | 75 | 75 | 75 | 75 | 75 |
| 25 | 25 | 25 | 25 | 25 | 25 | 25 | 25 | 25 | 25 | 25 | 25 | 75 | 75 | 75 | 75 | 75 | 75 | 75 | 75 | 75 | 75 | 75 | 75 |
| 25 | 25 | 25 | 25 | 25 | 25 | 25 | 25 | 25 | 25 | 25 | 25 | 75 | 75 | 75 | 75 | 75 | 75 | 75 | 75 | 75 | 75 | 75 | 75 |
| 25 | 25 | 25 | 25 | 25 | 25 | 25 | 25 | 25 | 25 | 25 | 25 | 75 | 75 | 75 | 75 | 75 | 75 | 75 | 75 | 75 | 75 | 75 | 75 |
| 25 | 25 | 25 | 25 | 25 | 25 | 25 | 25 | 25 | 25 | 25 | 25 | 75 | 75 | 75 | 75 | 75 | 75 | 75 | 75 | 75 | 75 | 75 | 75 |
| 25 | 25 | 25 | 25 | 25 | 25 | 25 | 25 | 25 | 25 | 25 | 25 | 75 | 75 | 75 | 75 | 75 | 75 | 75 | 75 | 75 | 75 | 75 | 75 |
| 25 | 25 | 25 | 25 | 25 | 25 | 25 | 25 | 25 | 25 | 25 | 25 | 75 | 75 | 75 | 75 | 75 | 75 | 75 | 75 | 75 | 75 | 75 | 75 |
| 25 | 25 | 25 | 25 | 25 | 25 | 25 | 25 | 25 | 25 | 25 | 25 | 75 | 75 | 75 | 75 | 75 | 75 | 75 | 75 | 75 | 75 | 75 | 75 |
| 25 | 25 | 25 | 25 | 25 | 25 | 25 | 25 | 25 | 25 | 25 | 25 | 75 | 75 | 75 | 75 | 75 | 75 | 75 | 75 | 75 | 75 | 75 | 75 |
| 25 | 25 | 25 | 25 | 25 | 25 | 25 | 25 | 25 | 25 | 25 | 25 | 75 | 75 | 75 | 75 | 75 | 75 | 75 | 75 | 75 | 75 | 75 | 75 |
| 25 | 25 | 25 | 25 | 25 | 25 | 25 | 25 | 25 | 25 | 25 | 25 | 75 | 75 | 75 | 75 | 75 | 75 | 75 | 75 | 75 | 75 | 75 | 75 |
| 25 | 25 | 25 | 25 | 25 | 25 | 25 | 25 | 25 | 25 | 25 | 25 | 75 | 75 | 75 | 75 | 75 | 75 | 75 | 75 | 75 | 75 | 75 | 75 |
| 25 | 25 | 25 | 25 | 25 | 25 | 25 | 25 | 25 | 25 | 25 | 25 | 75 | 75 | 75 | 75 | 75 | 75 | 75 | 75 | 75 | 75 | 75 | 75 |
| 25 | 25 | 25 | 25 | 25 | 25 | 25 | 25 | 25 | 25 | 25 | 25 | 75 | 75 | 75 | 75 | 75 | 75 | 75 | 75 | 75 | 75 | 75 | 75 |
| 25 | 25 | 25 | 25 | 25 | 25 | 25 | 25 | 25 | 25 | 25 | 25 | 75 | 75 | 75 | 75 | 75 | 75 | 75 | 75 | 75 | 75 | 75 | 75 |
| 25 | 25 | 25 | 25 | 25 | 25 | 25 | 25 | 25 | 25 | 25 | 25 | 75 | 75 | 75 | 75 | 75 | 75 | 75 | 75 | 75 | 75 | 75 | 75 |
| 25 | 25 | 25 | 25 | 25 | 25 | 25 | 25 | 25 | 25 | 25 | 25 | 75 | 75 | 75 | 75 | 75 | 75 | 75 | 75 | 75 | 75 | 75 | 75 |
| 25 | 25 | 25 | 25 | 25 | 25 | 25 | 25 | 25 | 25 | 25 | 25 | 75 | 75 | 75 | 75 | 75 | 75 | 75 | 75 | 75 | 75 | 75 | 75 |
| 25 | 25 | 25 | 25 | 25 | 25 | 25 | 25 | 25 | 25 | 25 | 25 | 75 | 75 | 75 | 75 | 75 | 75 | 75 | 75 | 75 | 75 | 75 | 75 |
| 25 | 25 | 25 | 25 | 25 | 25 | 25 | 25 | 25 | 25 | 25 | 25 | 75 | 75 | 75 | 75 | 75 | 75 | 75 | 75 | 75 | 75 | 75 | 75 |
| 25 | 25 | 25 | 25 | 25 | 25 | 25 | 25 | 25 | 25 | 25 | 25 | 75 | 75 | 75 | 75 | 75 | 75 | 75 | 75 | 75 | 75 | 75 | 75 |

FIG. 6

| | | | | | | | | | | | | | | | | | | | | | | | |
|---|---|---|---|---|---|---|---|---|---|---|---|---|---|---|---|---|---|---|---|---|---|---|---|
| 25 | 25 | 25 | 25 | 25 | 25 | 25 | 25 | 25 | 25 | 25 | 25 | 75 | 75 | 75 | 75 | 75 | 75 | 75 | 75 | 75 | 75 | 75 | 75 |
| 25 | 25 | 25 | 25 | 25 | 25 | 25 | 25 | 25 | 25 | 25 | 25 | 75 | 75 | 75 | 75 | 75 | 75 | 75 | 75 | 75 | 75 | 75 | 75 |
| 25 | 25 | 25 | 25 | 25 | 25 | 25 | 25 | 25 | 25 | 25 | 25 | 75 | 75 | 75 | 75 | 75 | 75 | 75 | 75 | 75 | 75 | 75 | 75 |
| 25 | 25 | 25 | 25 | 25 | 25 | 25 | 25 | 25 | 25 | 25 | 25 | 75 | 75 | 75 | 75 | 75 | 75 | 75 | 75 | 75 | 75 | 75 | 75 |
| 25 | 25 | 25 | 25 | 25 | 25 | 25 | 25 | 25 | 25 | 25 | 25 | 75 | 75 | 75 | 75 | 75 | 75 | 75 | 75 | 75 | 75 | 75 | 75 |
| 25 | 25 | 25 | 25 | 25 | 25 | 25 | 25 | 25 | 25 | 25 | 25 | 75 | 75 | 75 | 75 | 75 | 75 | 75 | 75 | 75 | 75 | 75 | 75 |
| 25 | 25 | 25 | 25 | 25 | 25 | 25 | 25 | 25 | 25 | 25 | 25 | 75 | 75 | 75 | 75 | 75 | 75 | 75 | 75 | 75 | 75 | 75 | 75 |
| 25 | 25 | 25 | 25 | 25 | 25 | 25 | 25 | 25 | 25 | 25 | 25 | 75 | 75 | 75 | 75 | 75 | 75 | 75 | 75 | 75 | 75 | 75 | 75 |
| 25 | 25 | 25 | 25 | 25 | 25 | 25 | 25 | 25 | 25 | 25 | 25 | 75 | 75 | 75 | 75 | 75 | 75 | 75 | 75 | 75 | 75 | 75 | 75 |
| 25 | 25 | 25 | 25 | 25 | 25 | 25 | 25 | 25 | 25 | 25 | 25 | 75 | 75 | 75 | 75 | 75 | 75 | 75 | 75 | 75 | 75 | 75 | 75 |
| 25 | 25 | 25 | 25 | 25 | 25 | 25 | 25 | 25 | 25 | 25 | 25 | 75 | 75 | 75 | 75 | 75 | 75 | 75 | 75 | 75 | 75 | 75 | 75 |
| 25 | 25 | 25 | 25 | 25 | 25 | 25 | 25 | 25 | 25 | 25 | 25 | 75 | 75 | 75 | 75 | 75 | 75 | 75 | 75 | 75 | 75 | 75 | 75 |
| 25 | 25 | 25 | 25 | 25 | 25 | 25 | 25 | 25 | 25 | 25 | 25 | 75 | 75 | 75 | 75 | 75 | 75 | 75 | 75 | 75 | 75 | 75 | 75 |
| 25 | 25 | 25 | 25 | 25 | 25 | 25 | 25 | 25 | 25 | 25 | 25 | 75 | 75 | 75 | 75 | 75 | 75 | 75 | 75 | 75 | 75 | 75 | 75 |
| 25 | 25 | 25 | 25 | 25 | 25 | 25 | 25 | 25 | 25 | 25 | 25 | 75 | 75 | 75 | 75 | 75 | 75 | 75 | 75 | 75 | 75 | 75 | 75 |
| 25 | 25 | 25 | 25 | 25 | 25 | 25 | 25 | 25 | 25 | 25 | 25 | 75 | 75 | 75 | 75 | 75 | 75 | 75 | 75 | 75 | 75 | 75 | 75 |
| 25 | 25 | 25 | 25 | 25 | 25 | 25 | 25 | 25 | 25 | 25 | 25 | 75 | 75 | 75 | 75 | 75 | 75 | 75 | 75 | 75 | 75 | 75 | 75 |
| 25 | 25 | 25 | 25 | 25 | 25 | 25 | 25 | 25 | 25 | 25 | 25 | 75 | 75 | 75 | 75 | 75 | 75 | 75 | 75 | 75 | 75 | 75 | 75 |
| 25 | 25 | 25 | 25 | 25 | 25 | 25 | 25 | 25 | 25 | 25 | 25 | 75 | 75 | 75 | 75 | 75 | 75 | 75 | 75 | 75 | 75 | 75 | 75 |
| 25 | 25 | 25 | 25 | 25 | 25 | 25 | 25 | 25 | 25 | 25 | 25 | 75 | 75 | 75 | 75 | 75 | 75 | 75 | 75 | 75 | 75 | 75 | 75 |
| 25 | 25 | 25 | 25 | 25 | 25 | 25 | 25 | 25 | 25 | 25 | 25 | 75 | 75 | 75 | 75 | 75 | 75 | 75 | 75 | 75 | 75 | 75 | 75 |
| 25 | 25 | 25 | 25 | 25 | 25 | 25 | 25 | 25 | 25 | 25 | 25 | 75 | 75 | 75 | 75 | 75 | 75 | 75 | 75 | 75 | 75 | 75 | 75 |
| 25 | 25 | 25 | 25 | 25 | 25 | 25 | 25 | 25 | 25 | 25 | 25 | 75 | 75 | 75 | 75 | 75 | 75 | 75 | 75 | 75 | 75 | 75 | 75 |

virtual frame M image signal
25 25 25 virtual frame Q image signal
25 25 25

FIG. 40 (a) (N-1) frame
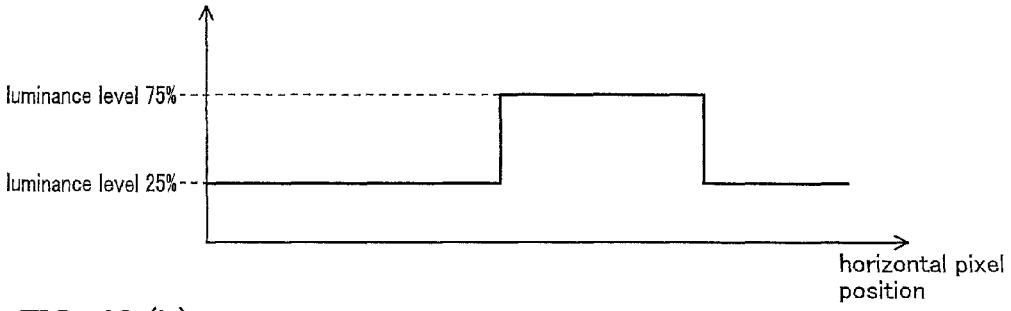
FIG. 40 (b) (Nth) frame
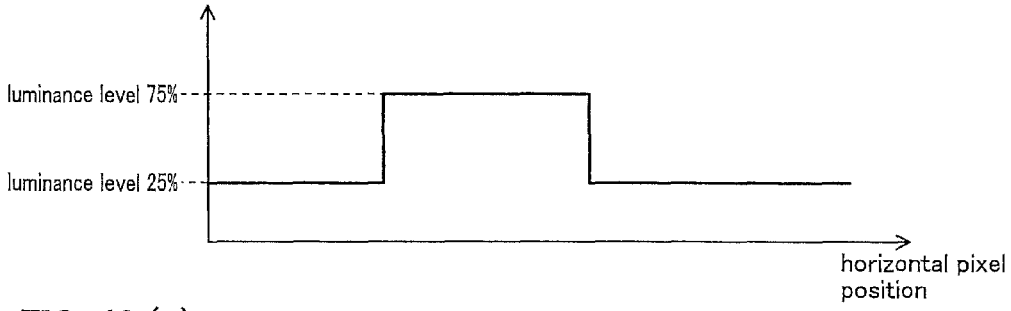
FIG. 40 (c) accurate middle time point virtual frame
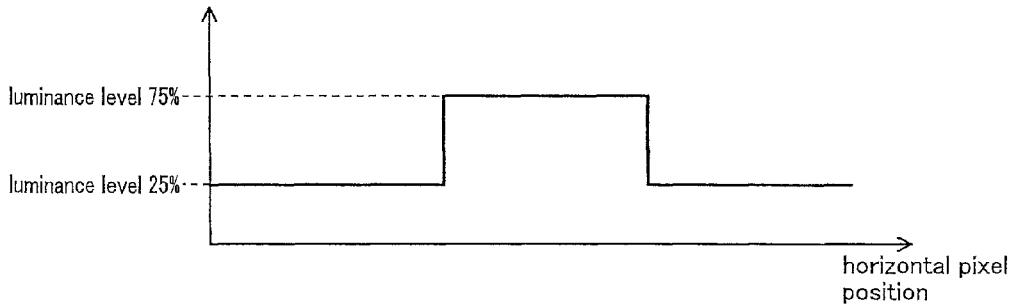
FIG. 40 (d) middle time point virtual frame including estimation error
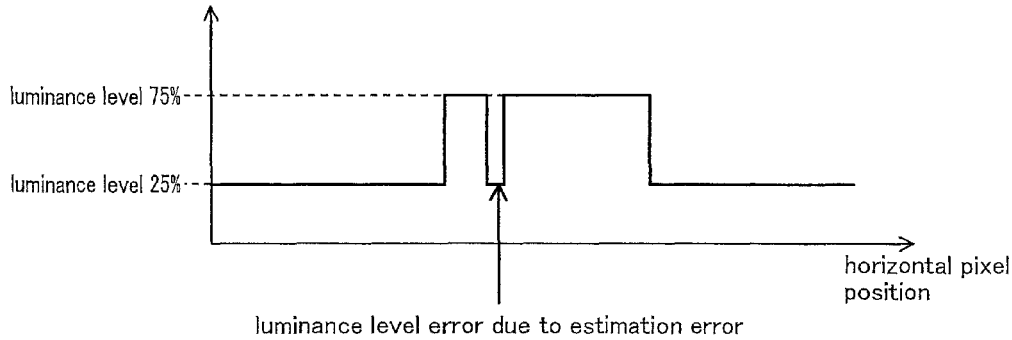

IMAGE DISPLAYING METHOD AND IMAGE DISPLAYING APPARATUS

PRIORITY STATEMENT

The present application is a divisional under 35 U.S.C. §§120, 121 of application Ser. No. 12/072,000, filed on Feb. 28, 2008, which is a continuation-in-part of PCT Application No. PCT/JP2006/320111, filed on Oct. 6, 2006, which claims priority under 35 U.S.C. §119 to Japan Application Number 2005-322685 filed Nov. 7, 2005, the entire contents of each of which is hereby incorporated herein by reference.

TECHNICAL FIELD

The present invention relates to an image displaying apparatus such as a liquid crystal display apparatus and an image displaying method thereof.

BACKGROUND ART

An image displaying apparatus using a hold-type display apparatus such as a liquid crystal display apparatus has a problem of degradation of moving picture quality (indistinct edge).

The following explains the degradation of moving picture quality (indistinct edge) in a conventional hold-type display apparatus with reference to FIG. 29. FIG. 29 shows a case where a region of an image signal 75% in luminance level moves in the horizontal direction on a background of a image signal 25% in luminance level.

FIG. 30 shows luminance level distribution for pixels on a 1-horizontal line on a picture, with respect to an input image signal supplied to a frame for such image display.

FIG. 31 shows time transition in a display luminance distribution of a conventional hold-type display apparatus in such a movement of an image in the horizontal direction. An observer gazing a picture generally follows an object moving in the horizontal direction, and therefore, he/she recognizes a luminance level as an integral amount of display luminance level in the direction denoted by an arrow. FIG. 32 is a numeric value of a luminance level for each pixel of an input image signal on a 1 horizontal line in 1 frame period divided into 8 parts. In this figure, the luminance response time of a display apparatus is not taken into account for ease of explanation.

The visible luminance distribution for an observer is an integral value of luminance level which is a mean value of the luminance levels of respective times in the arrow direction, provided that the movement speed of the object (75% luminance region) is 8 pixel/frame. FIG. 33 is a graph showing the distribution of the luminance level. This luminance level is luminance level distribution connected by an inclined line component in the vicinity of a boundary between a region 25% in luminance level and a 75% luminance region. The width of the line component in the horizontal direction is seen as an indistinct edge. This is a reason of the decrease in moving picture quality in a hold-type display apparatus.

Providing a minimum luminance level (black) display period in a part of the display 1 frame period is the easiest way of reducing the indistinct edge. However, in this case, the light state and the dark state are repeated in each frame period in the entire image, and flicker occurs. Further, since the minimum luminance level display period always exists in 1 frame period even when the input image signal is maximum, the luminance level decreases.

The following explains a case where the width of the 75% luminance region is smaller than the transition amount of 1 frame period in the background 25% in luminance level, as shown in FIG. 34.

FIG. 35 is luminance level distribution for pixels on a 1-horizontal line on a picture, with respect to an input image signal supplied to a frame on the image display shown in FIG. 34. FIG. 36 shows time transition of a display luminance distribution in a conventional hold-type display apparatus in such an image movement in the horizontal direction. FIG. 37 is a table of numerical values of the pixels on 1 horizontal line in 1 frame period divided into 8 parts.

The visible luminance distribution for an observer is an integral value of luminance level which is a mean value of the luminance levels of respective times in the arrow direction, provided that the movement speed of the object (75% luminance region) is 8 pixel/frame. FIG. 38 is a graph showing the distribution of the luminance level.

As shown in FIG. 38, this case does not have a large indistinct edge as with the one of FIG. 33; however, the luminance level of the object which is supposed to move with a luminance level of 75% is decreased to 44%.

This means that the moving object is seen a lot darker than it should be. This is another reason of a decrease in moving picture quality.

Further, in an inverse case where a luminance level in the transition region is low and the luminance level of the background is high, there is a phenomenon in which the luminance in the transition region is seen lighter than it should be, and the moving picture quality decreases by the same cause.

Japanese patent No. 3295437 (Patent Document 1) discloses a method of reducing indistinct edges without causing flicker. As shown in FIG. 39, this method generates an assumed (middle time point) virtual frame image and inserts the virtual frame image between the subsequent 2 frames. In this way, the indistinct edges are reduced, and degradation of moving picture quality is suppressed.

[Patent Document 1] Japanese Patent Publication Patent No. 3295437 publication (published on Jun. 24, 2002).

DISCLOSURE OF INVENTION

However, in the method of Patent Document 1, it is difficult to estimate an image signal between the two frames with perfect accuracy, and therefore defective operation due to estimation error is always possible.

With regard to 1 horizontal line in a picture in the case where a region of an image signal 75% in luminance level moves in the horizontal direction on a background of an image signal 25% in luminance level as shown in FIG. 29, FIG. 40(*a*) shows luminance level distribution of an input image signal of the (N−1)th frame, and FIG. 40(*b*) shows luminance level distribution of an input image signal of the Nth frame. In this case, if a virtual frame in the middle time point of the (N−1)th frame and the Nth frame can be generated with perfectly accurate estimation, it will be luminance level distribution in which the 75% luminance region resides in the middle of the (N−1)th frame and the Nth frame, as shown in FIG. 40(*c*). However, it is difficult to estimate an image signal between the two frames with perfect accuracy, and therefore defective operation due to estimation error is always possible. FIG. 40 (*d*) shows an example of virtual frame in the middle time point. This virtual frame includes an error. As denoted by an arrow, a pixel 25% in luminance is generated in a portion whose original luminance is 75%.

FIG. 41 shows numerical values indicating condition of luminance level in 1 frame period when such an error occurs in a virtual frame in the middle time point. On the other hand, FIG. 42 shows a distribution of integral amount of visible luminance level for an observer following a moving object. In this example, the estimation error of a virtual frame does not occur in the vicinity of the right edge of the 75% luminance region, and the distribution of integrated amount of luminance level is proper. This shows that the indistinct edge width is suppressed compared with the conventional hold-type display apparatus shown in FIG. 33. However, there is a level difference in the distribution waveform of the luminance level integrated amount in the vicinity of the left edge (the circle portion of FIG. 42) of the 75% region due to an estimation error of a virtual frame. This causes degradation of picture quality, such as image noise.

The present invention is made in view of the foregoing conventional problem, and an object is to realize an image displaying method and an image displaying apparatus which can ensure an improved moving picture quality without causing a decrease in luminance or flicker.

In order to attain the foregoing object, image displaying method and image displaying apparatus according to the present invention is an image displaying method for displaying an image based on an image signal in each pixel for each frame period corresponding to the image signal of a picture, wherein: 1 frame is divided into plural sub-frame periods including at least one sub-frame A period and at least one sub-frame B period, and the following condition is satisfied on input of an image of a frame in which a region supplied with an image signal $\alpha$ and a region supplied with an image signal $\beta$ satisfying $\alpha<\beta$ are adjacent to each other, $\alpha\leq\alpha A<\beta$, $\alpha B\leq\alpha$, where $\alpha A$ expresses an image signal for image output in the sub-frame A period and $\alpha B$ expresses an image signal for image output in the sub-frame B period, in each pixel in the region supplied with an image signal $\alpha$, $\alpha<\beta A\leq\beta$, $\beta\leq\beta B$, where $\beta A$ expresses an image signal for image output in the sub-frame A period and $\beta B$ expresses an image signal for image output in the sub-frame B period, in each pixel in the region supplied with an image signal $\beta$, and, on condition that $D=\beta-\alpha$, $DA=|\beta A-\alpha A|$, $DB=|\beta B-\alpha B|$, the following condition is satisfied, $$DA\leq D, D\leq DB, \text{ and } DA<DB.$$

With this structure, display outputs in the sub-frame A period and B period are performed with image signals $\alpha A$, $\alpha B$, $\beta A$, and $\beta B$ satisfying the following condition.

$$\alpha\leq\alpha A<\beta, \alpha B\leq\alpha, \alpha<\beta A\leq\beta, \beta\leq\beta B, DA\leq D, D\leq DB, DA<DB.$$

That is, the difference between the two adjacent regions in the image signal decreases in the sub-frame A period, and increases (emphasized) in the sub-frame B period. In this way, the present invention provides an effect of improvement in moving picture quality of a hold-type display device without causing a decrease in luminance or flicker.

BRIEF DESCRIPTION OF DRAWINGS

FIG. 3 A drawing showing a rectangular range, which is an example of a reference range of image signal level calculation.

FIG. 4 A drawing showing a circular range, which is an example of a reference range of image signal level calculation.

FIG. 5 A drawing showing an ellipsoidal range, which is an example of a reference range of image signal level calculation.

FIG. 6 A drawing showing a polygonal range, which is an example of a reference range of image signal level calculation.

FIG. 23(*b*) A drawing showing luminance levels for the respective positions of horizontal pixels in the Nth frame.

FIG. 23(*c*) A drawing showing luminance levels for the respective positions of horizontal pixels in a virtual sub-frame Q.

FIG. 26(*b*) A drawing showing luminance levels for the respective positions of horizontal pixels in the Nth frame.

FIG. 26(*c*) A drawing showing luminance levels for the respective positions of horizontal pixels in a virtual sub-frame Q.

FIG. 40(*a*) A drawing showing luminance levels for the respective positions of horizontal pixels in the (N−1)th frame.

FIG. 40(*b*) A drawing showing luminance levels for the respective positions of horizontal pixels in the Nth frame.

FIG. 40(*c*) A drawing showing luminance levels for the respective positions of horizontal pixels in a virtual frame in an accurate middle time point.

FIG. 40(*d*) A drawing showing luminance levels for the respective positions of horizontal pixels in a virtual frame in a middle time point including an estimation error.

BEST MODE FOR CARRYING OUT THE INVENTION

First Embodiment

Figure 1:
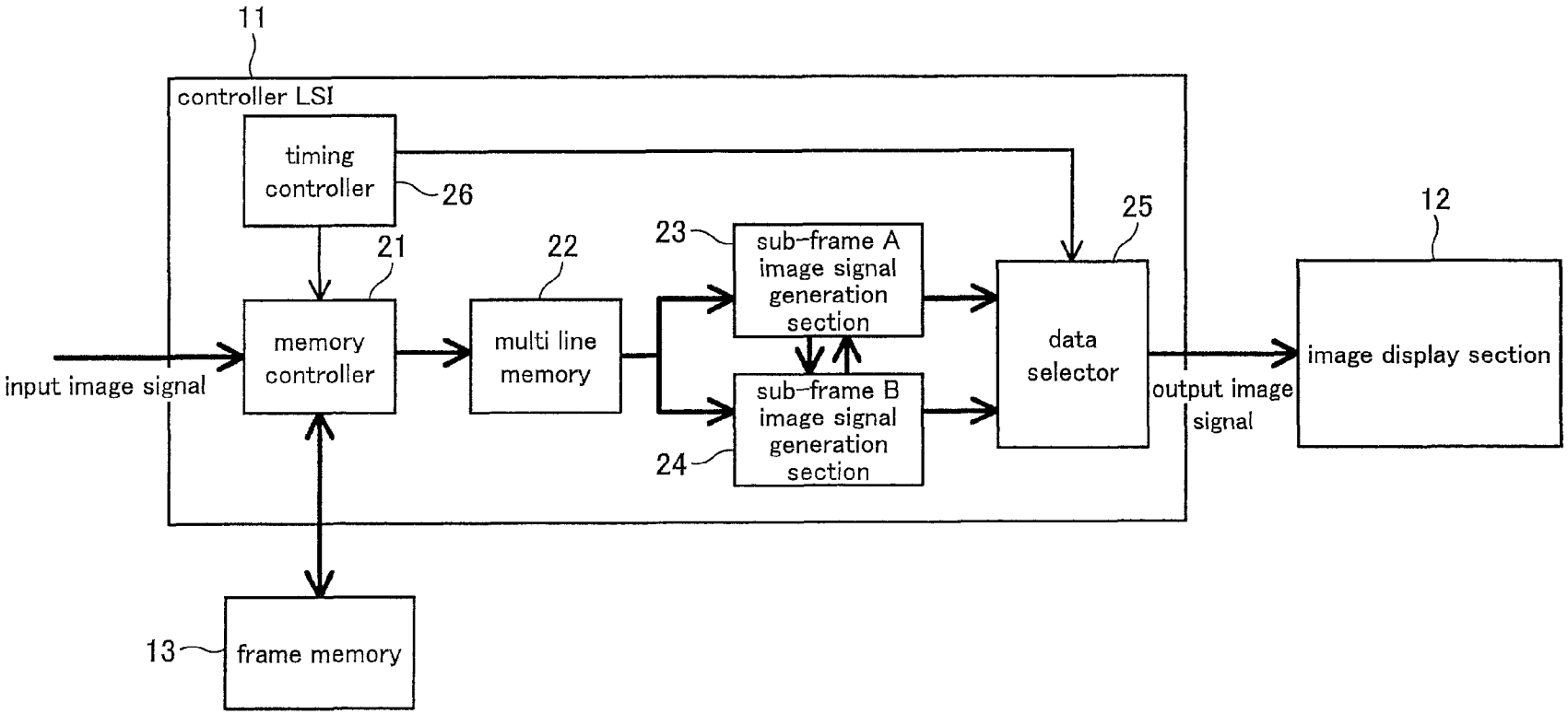
FIG. 1 A block diagram showing a structure example of an image displaying apparatus.

FIG. 1 shows a structure of an image displaying apparatus according to the present embodiment. In this image displaying apparatus, a controller LSI11 (display control section) is connected to an image display section 12, such as a liquid crystal panel, and a frame memory 13. The controller LSI11 includes a timing controller 26, a memory controller 21, a multi line memory 22, a sub-frame A image signal generation section 23, a sub-frame B image signal generation section 24, and a data selector 25.

The timing controller 26 generates timings of a sub-frame A period and a sub-frame B period which are two divisional periods of a 60 Hz input frame period, so as to control the memory controller 21 and the data selector 25.

The memory controller 21 first (1) writes a 60 Hz input image signal into the frame memory 13, and then (2) transmits an image signal of 1 frame having been written into a frame memory 13 to the multi line memory 22 at a frame period of 120 Hz. That is, two rounds of the same frame are read out. The processes (1) and (2) are carried out concurrently in a time-divisional manner.

The multi line memory 22 holds an image signal for a Y-line including the horizontal line being displayed in the middle.

The sub-frame A image signal generation section 23 supplies image signals for a horizontal X pixel including a target pixel and for a vertical Y-line through a multi-line memory, and sets a range of X pixel×Y pixel to be used as a reference range. The mean value of the image signal levels of the respective pixels in this range is determined as a sub-frame A image signal of said pixel. The method of finding a mean value is described later. Specifically speaking, the image signal level is a gradation level or a luminance level, as in the later examples.

Next, the sub-frame B image signal generation section 24 generates a sub-frame B image signal for the target pixel, so that the time integrated amount of a luminance level of a 1 frame period constituted of the sub-frame A image signal and the image signal of the sub-frame B (sub-frame B image signal) corresponds to a luminance level of an input image signal. The resulting sub-frame B image signal has a larger difference between the input image signal and a mean value of the input image signals of the respective pixels in the reference range. The method of finding the sub-frame B image signal is described later.

At this time, if the constant accordance of the displayed luminance level with the luminance level of the input image signal is more important than improvement in moving picture quality, in the case where the integrated amount of the luminance is larger than the luminance level of the input image signal even when the sub-frame B image signal is the smallest image signal, the sub-frame B image signal is determined to be the smallest image signal and the sub-frame A image signal is set so that the integrated amount of the luminance becomes identical to the luminance level of the input image signal. Similarly, in the case where the integrated amount of the luminance is smaller than the luminance level of the input image signal even when the sub-frame B image signal is the largest image signal, the sub-frame B image signal is determined to be the largest image signal and the sub-frame A image signal is set so that the integrated amount of the luminance becomes identical to the luminance level of the input image signal.

The data selector 25 selects either of the sub-frame A image signal and the sub-frame B image signal according to the current display sub-frame phase, and transmits the selected signal to the image display section 12.

The image display section 12 carries out image display according to the image signal received.

Note that, this display control section may be easily manufactured by an ASIC (IC for specific purpose) using the logics. Note also that, the image display section is an image display device such as a liquid crystal panel, also in the other embodiments.

Figure 43:
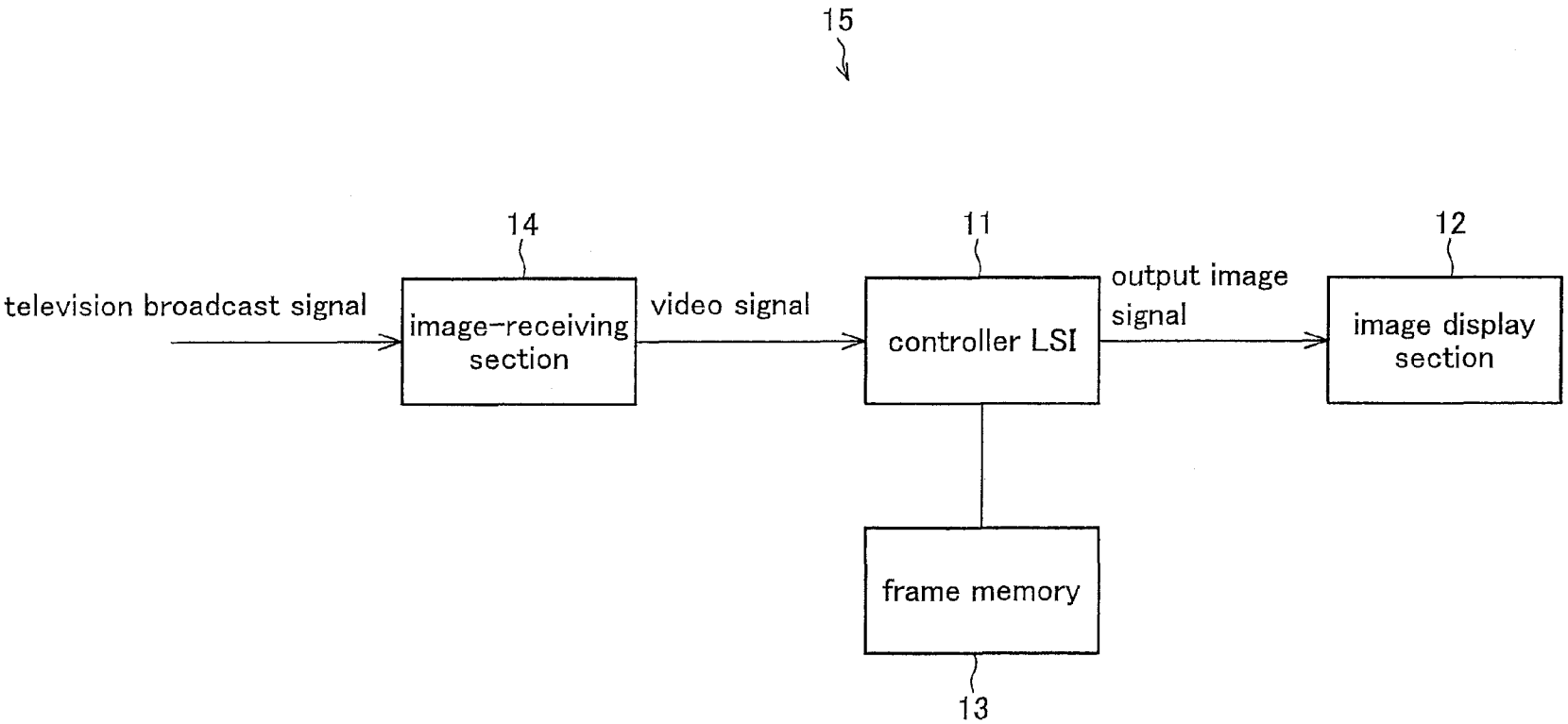
FIG. 43 A block diagram showing an structure example of an image displaying apparatus serving as a liquid crystal television image-receiver.

As shown in FIG. 43, the image displaying apparatus may be composed as a liquid crystal television image-receiver 15, for example. More specifically, the image displaying apparatus may include an image-receiving section 14 which serves as a tuner section for receiving television broadcast of a selected channel, and supplying video signals denoting images transmitted through the television broadcast to the controller LSI11 as input image signals. Then, the image display section 12 is constituted of a liquid crystal panel, and may have a function of displaying images based on output image signals transmitted from the controller LSI11 based on the video signals.

The image displaying apparatus divides a display 1 frame period into two sub-frames identical in period length in a time divisional manner. Then image displaying apparatus carries out the following process for the entire pixels on the picture. In the sub-frame A period, a mean image signal of the input image signals to the pixels within a certain range in the vicinity of the target pixel is outputted (averaging), and in the sub-frame B period, an image signal for emphasizing the difference between the input image signal of the target pixel and the mean input image signal of the input image signals to the pixels within a certain range in the vicinity of the target pixel is outputted (emphasis).

Then, the image displaying apparatus divides 1 frame into plural sub-frame periods, and modifies the image signals in the following manner in the case of receiving an image of a frame in which a region denoted by an image signal $\alpha$ or an image signal close to the image signal $\alpha$ and a region of another image signal $\beta$ or an image signal close to the image signal $\beta$ are adjacent to each other. Specifically, the image displaying apparatus carries out display, in at least one sub-frames period A, with a modified image signal so that the difference with the image signal of the other region becomes smaller, and in at least one other sub-frames period B, with a modified image signal so that the difference with the image signal of the other region becomes more significant, in the vicinity of the boundary between the region of the image signal $\alpha$ and the region of the image signal $\beta$.

To be more specific, the image signals $\alpha$ and $\beta$ are modified to the following signals A, $\alpha$B, $\beta$A, and $\beta$B.

That is, in the case of receiving an image signal of 1 frame in which the region of a pixel supplied with an image signal $\alpha$ and the region of a pixel supplied with an image signal $\beta$ satisfying $\alpha<\beta$ are adjacent to each other, the following condition is satisfied.

$$\alpha \leq \alpha A < \beta, \alpha B \leq \alpha,$$

where $\alpha$A expresses an image signal for image output in the sub-frame A period and $\alpha$B expresses an image signal for image output in the sub-frame B period, in pixels in a region supplied with an image signal $\alpha$, and also the following condition is satisfied.

$$\alpha < \beta A \leq \beta, \beta \leq \beta B,$$

where $\beta$A expresses an image signal for image output in the sub-frame A period and $\beta$B expresses an image signal for image output in the sub-frame B period, in pixels in a region supplied with an image signal $\beta$, Further, on condition that $D=\beta-\alpha$, $DA=|\beta A-\alpha A|$, $DB=|\beta B-\alpha B|$, the following condition is satisfied.

$$DA \leq D, D \leq DB, \text{ and } DA < DB.$$

Specifically, $\alpha$A is equal to or greater than $\alpha$, and smaller than $\beta$. $\alpha$B is equal to or smaller than $\alpha$. $\beta$A is equal to or smaller than $\beta$, and greater than $\alpha$. $\beta$B is equal to or greater than $\beta$.

To satisfy DA<DB, the conditions: DA=D, D<DB, DA<D, D=DB, DA<D, or D<DB can be assumed.

Where $\beta A>\alpha A$, $DA=\beta A-\alpha A$ is satisfied.

Similarly, where $\beta B>\alpha B$, $DB=\beta B-\alpha B$ is satisfied.

Further, by setting the condition: $\alpha A \leq \beta A$ of the image signals $\alpha$A and $\beta$A, the magnitude correlation among the image signals will not be reversed after the modification. Therefore, the moving picture quality can be improved more effectively.

The following discusses the boundary between a region of pixels supplied with the image signal $\alpha$ and a region of pixels supplied with image signal $\beta$, which satisfy: $\alpha<\beta$. An appropriate value of image signal $\alpha$A is a value which becomes closer to the image signal $\beta$ as it comes closer to the boundary, and becomes closer to the image signal $\alpha$ as it becomes more distant from the boundary. An appropriate value of image signal $\alpha$B is a value which becomes less than the image signal $\alpha$ as it comes closer to the boundary, and becomes closer to the image signal $\alpha$ as it becomes more distant from the boundary. An appropriate value of image signal $\beta$A is a value which becomes closer to the image signal $\alpha$ as it comes closer to the boundary, and becomes closer to the image signal $\beta$ as it becomes more distant from the boundary. An appropriate value of image signal $\beta$ is a value which becomes greater than the image signal $\beta$ as it comes closer to the boundary, and becomes closer to the image signal $\beta$ as it becomes more distant from the boundary. With these values, the difference among image signals in the vicinity of the boundary between the adjacent regions becomes more significant. Therefore, the moving picture quality can be improved more effectively.

[Mean Value]

The following explains a mean value generated as an example of sub-frame A image signal. The value used for calculation may be a gradation value of the original image signal, or a value converted from a gradation value into a display luminance level of an image displaying apparatus. The following explains a relationship between the display luminance and the gradation value.

Figure 2:
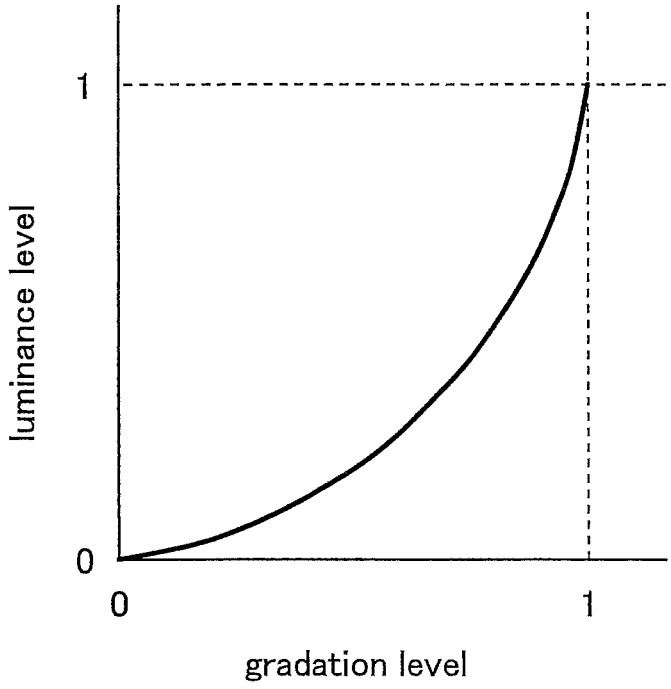
FIG. 2 A graph showing a relationship between gradation level and luminance level.

FIG. 2 is a drawing showing a gradation luminance characteristic of a display luminance level with respect to a gradation level of an image signal supplied to a general CRT (cathode ray tube). The gradation level and the luminance level are both canonicalized to have a minimum level=0 and a maximum level=1. In this case, the luminance level is $\gamma$-power ($\gamma \approx 2.2$) of the gradation level.

Most of gradation values of general image signals of TV (television) broadcast, video, DVD (Digital Versatile Disk) and PC (personal computer) output are generated in consideration of gradation luminance characteristic of CRT. Therefore, even a relatively new display apparatus such as a liquid crystal panel is designed to have a similar gradation luminance characteristic to that of CRT with respect to supplied gradation values. In using such an image displaying apparatus, conversion of a gradation value into a luminance level so as to find a mean value as a sub-frame An image signal increases the effect of improvement in moving picture quality. However, since the gradation value and the luminance level do not have a linear relationship, conversion into the luminance level causes an increase in data bit number for denoting image signals for a single pixel, which increases the cost. If the calculation is performed with the original gradation value to avoid the cost rise, a certain effect is ensured.

Next, the following discusses a reference range in the calculation of mean value. To equalize the effects of improvement in moving picture quality by the present invention in the movements in various directions, it is preferable to calculate the image signals in the circular range wherein the target pixel resides in the center.

However, in a general video picture of TV broadcast or movies, there are more horizontal movements than the vertical movements. Further, the movements of these video images are fast. Therefore, in application to a TV image-receiver or the like, it is more effective to carry out the averaging and emphasis processes in a larger range in the horizontal direction. Therefore, in this case, it is preferable to use a reference range of a horizontally-long ellipsoidal range wherein the target pixel resides in the center.

However, a circuit using a circular or ellipsoidal reference range has a complicated structure which requires high cost. Therefore, the reference may have an octagon or hexagon shape wherein the target pixel resides in the center. A rectangular region makes the calculation circuit further simpler.

Further, by setting the entire or a part of 1 horizontal line including the target pixel, the multi-line memory may be realized by a single line memory. Consequently the cost can be further reduced. However, the effect of improvement in moving picture quality by the present invention works only to pictures moving in the horizontal direction.

In the case of using the entire 1 horizontal line as a reference range, the all pixels have the same pixel signal values in each line of the sub-frame A period. However, in a method of finding a value corresponding to the input luminance by integral of the luminance of the sub-frame B and the luminance of the sub-frame A, if the integrated amount of time does not match with the input luminance even when the sub-frame B is maximized or minimized, the sub-frame A is adjusted so that the integrated amount of time matches with the input luminance in that pixel.

One or both of the sizes of the reference range in the vertical and horizontal directions are 1% or larger of the display picture. An excessive small size does not provide a sufficient effect, but an excessive large value requires high-speed calculation. For example, with a reference range of 1%, the data amount for calculation does not significantly increase, but a certain effect is obtained.

For example, an appropriate reference range at least includes "pixels in a 3% range in both sides of the horizontal direction+the target pixel".

Various setting is possible for the reference range, for example, the range may include the target pixel, i.e. the pixel to be modified, or may include not the target pixel but a pixel adjacent to the target pixel. Further, the range may be a range not including the target pixel but including all of the remaining pixels in the horizontal line (vertical line) having the target pixel.

Note that, the reference range for averaging calculation provides a substantially the same effect regardless of inclusion of the target pixel in the range.

The following discusses a concrete example of averaging calculation. An example is a method of finding a mean value (a value converted into a gradation value or a luminance level) of the image signals of the respective pixels in the reference range including the target pixel.

The following explains a calculation example of simple averaging using a rectangular reference range of a horizontal 21 pixel×vertical 13 line, including the target pixel. FIG. 3 shows distribution of input image signals of the respective pixels. In the figure, the part indicated by a broken line denotes input image signals of the respective pixels in the reference range of horizontal 21 pixel×vertical 13 line, including the target pixel. In this example, the value of the image signal in the sub-frame A is a mean value of the image signals of the respective pixels in the reference range including an image signal supplied to the target pixel, that is expressed by: $(25\times11\times13+75\times10\times13)/(21\times13)\approx49$.

Further, the following explains a case of simple averaging using a circular reference range of 349 pixels including the target pixel. FIG. 4 shows distribution of input image signals of the respective pixels in a part of a picture, and the part indicated by a broken line denotes input image signals of the respective pixels in the reference range of 349 pixels, including the target pixel. In this example, the value of the image signal in the sub-frame A is a mean value of the image signals of the respective pixels in the reference range including an image signal supplied to the target pixel, that is expressed by: $(25\times185+75\times164)/349\approx48$.

Further, the following explains a case of simple averaging using an ellipsoidal reference range of 247 pixels including the target pixel. FIG. 5 shows distribution of input image signals of the respective pixels in a part of a picture, and the part indicated by a broken line denotes input image signals of the respective pixels in the reference range of 247 pixels, including the target pixel. In this example, the value of the image signal in the sub-frame A is a mean value of the image signals of the respective pixels in the reference range including an image signal supplied to the target pixel, that is expressed by: $(25\times131+75\times116)/247\approx48$.

Further, the following explains a case of simple averaging using a polygon (hexagon, in this example) reference range of 189 pixels including the target pixel. FIG. 6 shows distribution of input image signals of the respective pixels in a part of a picture, and the part indicated by a broken line denotes input image signals of the respective pixels in the reference range of 189 pixels, including the target pixel. In this example, the value of the image signal in the sub-frame A is a mean value of the image signals of the respective pixels in the reference range including an image signal supplied to the target pixel, that is expressed by: $(25\times101+75\times88)/189\approx48$.

Note that, though this example uses a mean value of the image signal level (more specifically, the luminance level etc. thereof) of the pixels in the reference range, it is not limited to a mean value, as long as the image signal levels of the respective pixels are set so that the difference between the image signal level of the target pixel and the image signal level of the reference range becomes small. The degree of reduction is arbitrarily determined by a manufacturer in consideration of various conditions such as picture quality, manufacturing costs etc.

[Method of Determining the Sub-Frame B Image Signal]

In the image displaying apparatus, 1 frame period is constituted of a sub-frame A period and a sub-frame B period, and therefore the image signal in the sub-frame B period is determined so that the integrated amount of the display luminance of the sub-frame A period determined in the foregoing manner and the display luminance of the sub-frame B period becomes identical to the luminance level of the input image signal. This is specifically carried out through calculation based on the response speed performance of the image display panel, or provision of a conversion table which allows output of an appropriate sub-frame B image for each combination of the input image signal and the sub-frame A image signal based on the luminances of the respective image signals previously measured.

Note that, if the constant accordance of the displayed luminance level with the luminance level of the input image signal is more important than improvement in moving picture quality, in the case where the integrated amount of the luminance is smaller than the luminance level of the input image signal even when the sub-frame B image signal is the largest image signal, or in the opposite case where the integrated amount of the luminance is larger than the luminance level of the input image signal even when the sub-frame B image signal is the smallest image signal, the sub-frame A image signal may be adjusted so that the integrated amount of the luminance becomes identical to the luminance level of the input image signal.

Here, the image signal level is expressed as Ls, the image signal level in the sub-frame A with respect to the pixel found by the averaging calculation is expressed as La, and an image signal level of the sub-frame B is expressed as Lb. In the case where 1 frame period is constituted of the sub-frame A and the sub-frame B, the time integrated amount of the luminance corresponding to the input image signal level needs to be achieved by the display of the sub-frame A and the sub-frame B.

For an image displaying apparatus whose rise speed and fall speed are symmetrical, the condition: Lb=2Ls−La is set. This condition formula is to match the time integrated value of the luminance levels of the sub-frame A and the sub-frame B with the input luminance so that display of a still image (for which an observer does not follow the movement of the object) is displayed with an appropriate luminance with respect to the input luminance level. Note that, the value of Lb not equal but close to the right hand of figure also ensures an effect of reducing the indistinct edge though the effect is not as significant as the value of Lb equal to the right hand of the figure.

On the other hand, for example, in the case of a display apparatus whose rise speed and fall speed are asymmetrical, such as a liquid crystal display apparatus, the value of Lb cannot be simply determined by the condition: Lb=2Ls−La if the display luminance corresponding to the input signal is expected. More specifically, the image signal supplied to the liquid-crystal panel denotes an level of liquid crystal to be attained. However, since the response speed of the existing liquid crystal is low, the sub-frame A period ends before the target level, and the supply of image signal to the next sub-frame B period starts. Therefore, the change in display luminance does not form a clear rectangle but a wave. Also, the rising waveform and the falling waveform are not similar. This shows that the total luminance (time integrated value) of the sub-frame A period and the sub-frame B period cannot be found by a simple calculation using the original image signal.

Therefore, in an actual product, the luminances of the image signals are measured and a conversion table is made according to the measurement results, or a calculation circuit (or software) for processing an equation form for finding the time integrated amount of luminances based on the response characteristic of liquid crystal is provided.

Concrete examples of this arrangement include a calculation circuit or software created according to the response characteristic of the display apparatus, which carries out real-time calculation/output of the Lb value corresponding to the input Ls and La; or provision of a value conversion LUT (look-up table) inside the LSI, which is created through a process, before product development, of measuring actual display luminances using a luminance scale while adjusting the value of Lb under fixed Ls and La, so as to determine the Lb value for realizing an appropriate display luminance corresponding to each combination of the Ls and La.

However, if reduction in cost for the conversion table is more important than the accordance of display luminance, or if an apparatus with an ideal level of response (liquid crystal or other types) is developed in the future, a method using a simple calculation is more effective.

Figure 29:
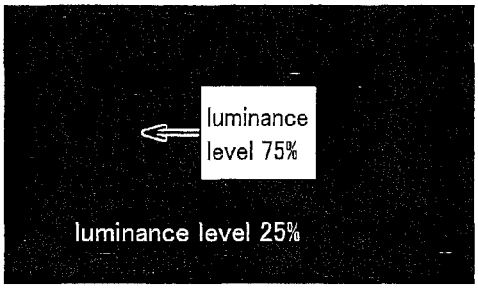
FIG. 29 A drawing showing a state where a 75% luminance region of an image signal moves in the horizontal direction on the background of an image signal whose luminance level is 25%.
Figure 30:
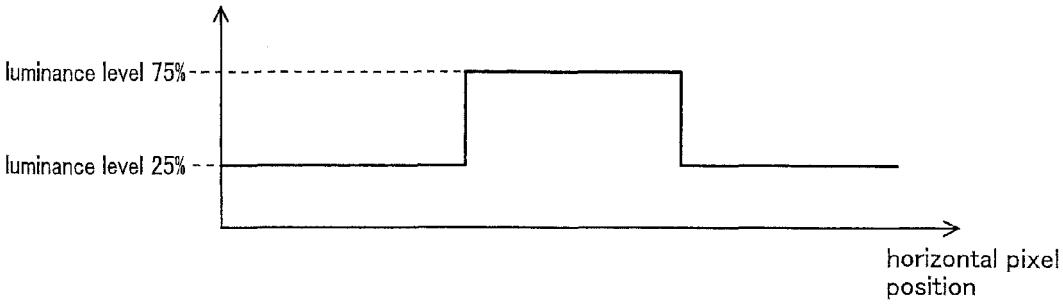
FIG. 30 A drawing showing luminance levels for the respective positions of horizontal pixels.
Figure 31:
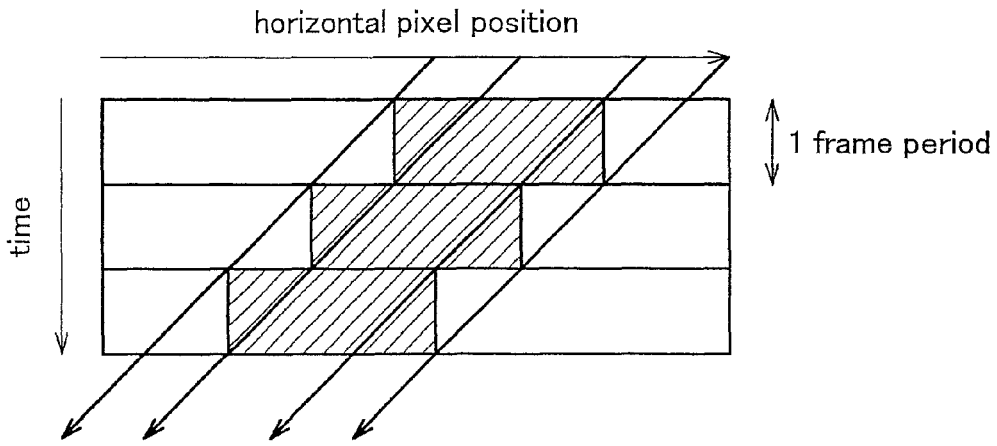
FIG. 31 A drawing showing a time transition of a display luminance distribution on the movement of an image in the horizontal direction.

Next, the following explains improvement of the degradation of moving picture quality (indistinct edge). In this example, a region of an image signal 75% in luminance level moves in the horizontal direction on a background of an image signal 25% in luminance level as shown in FIG. 29.

Note that, in this example, a light object moves on a dark object in this example, but the theory is the same for an inverse case, i.e. the case where a dark object moves on a light background. There is no substantial difference between "background" and "object", and if the luminance boundary moves, the indistinct edge is seen to an observer who is following the boundary.

Though this example only deals with horizontal movement, the method for avoiding generation of indistinct edge is totally the same in the vertical or oblique movement.

However, in a general video picture of TV broadcast or movies, there are more horizontal movements than the vertical movements. Further, the movements of these video images are fast. Therefore, it is more effective to carry out the averaging and emphasis processes in a larger range in the horizontal direction.

Figure 7:
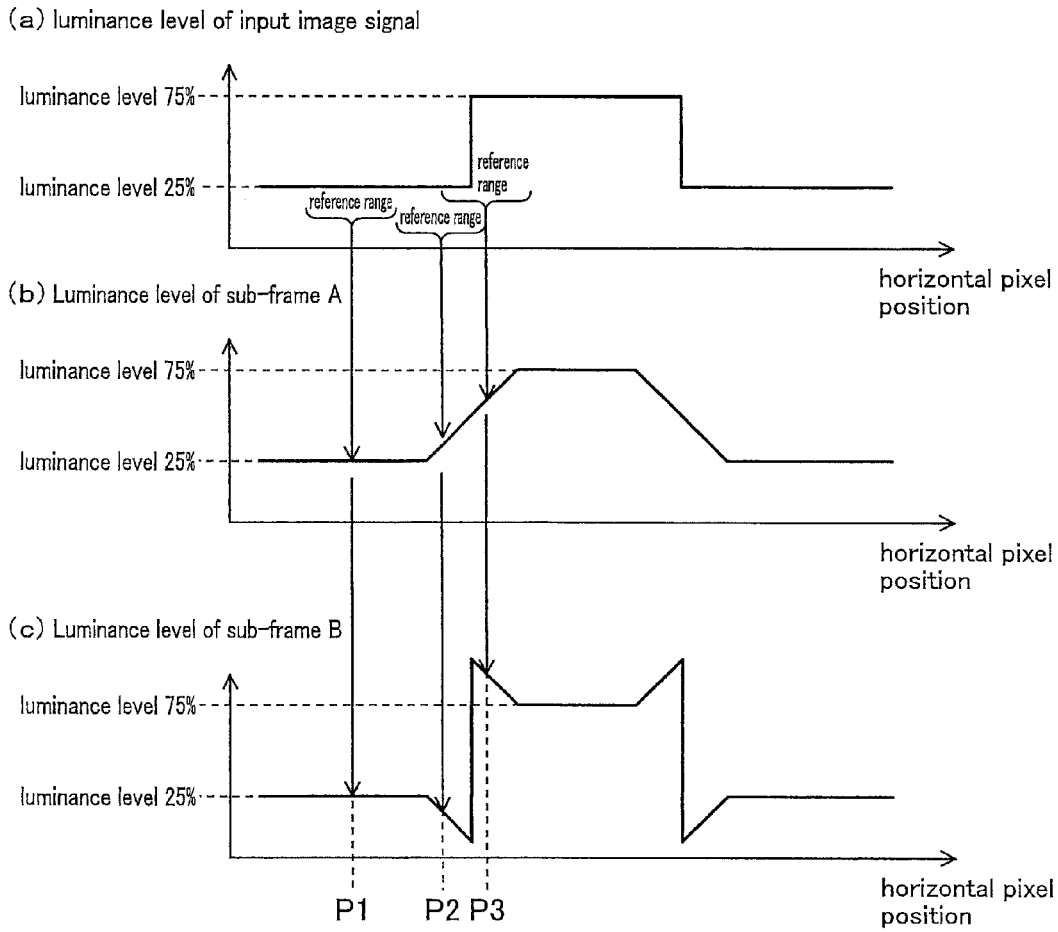
FIG. 7 (*a*) to (*c*) show luminance levels of the respective positions of horizontal pixels. (*a*) shows a luminance level of an input image signal, (*b*) shows a luminance level of a sub-frame A, and (*c*) shows a luminance level of a sub-frame B.

In the example of FIG. 29, FIG. 7(*a*) shows luminance level distribution with respect to the respective pixels on 1 horizontal line of an image signal supplied to a certain frame. The luminance levels actually shown in the sub-frame A and sub-frame B with respect to such an image signal on an image displaying apparatus are shown in FIG. 7(*b*) and FIG. 7(*c*).

The following explains a display luminance level in some points on a picture. The point P1 resides on a 25% luminance region of the input image signal, and the luminance levels of the image signals of all pixels in the reference range for generating the sub-frame A image signal is 25%. Therefore, the luminance level at the point P1 in the sub-frame A period is 25%, and the luminance level in the sub-frame B is also 25% so as to match the luminance level of 1 frame period with the luminance level of the input image signal.

On the other hand, the point P2 resides in a 25% luminance region of the input image signal but the reference range for generating the sub-frame A image signal partly overlaps with a 75% luminance region. To average the image signals in the reference range, the luminance level of the sub-frame A at the point 2 is greater than 25% and smaller than 75%. On the other hand, to match the luminance level of 1 frame period to the luminance level of the input image signal, the luminance level at the point P2 in the sub-frame B is smaller than 25%.

Similarly, at the point P3, the luminance level of the sub-frame A is smaller than 75%, and greater than 25%, and the luminance level of the sub-frame B is greater than 75%.

Figure 8:
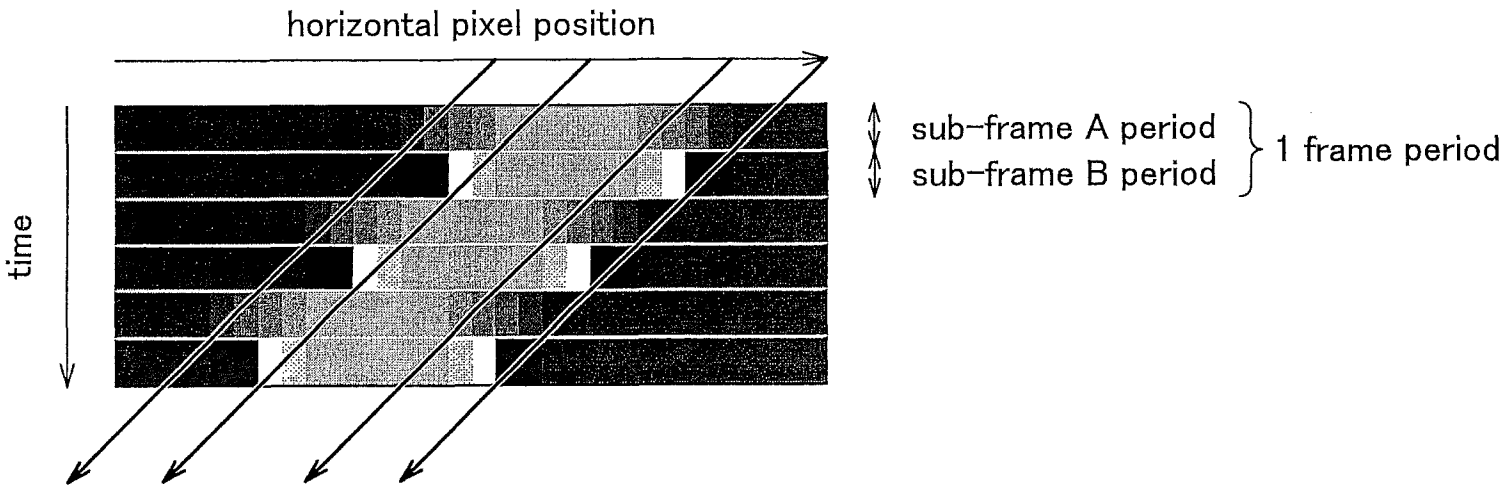
FIG. 8 A drawing showing a time transition of a display luminance distribution on the movement of an image in the horizontal direction.

FIG. 8 shows time transition of display luminance distribution in the horizontal movement of the foregoing image in the image displaying apparatus according to the present embodiment.

Figure 9:
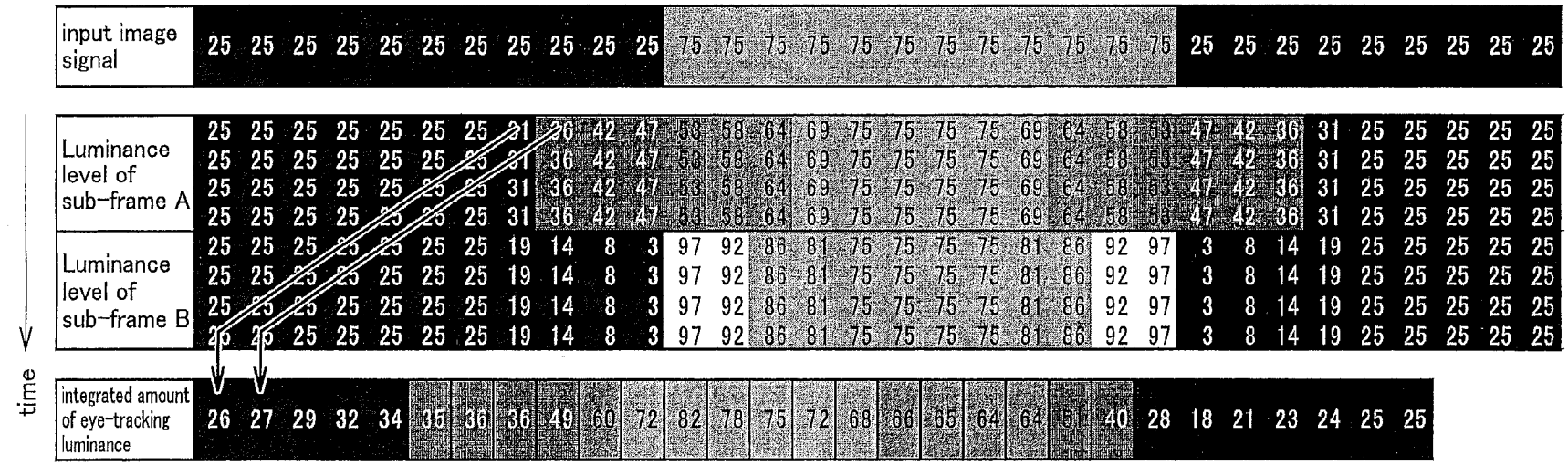
FIG. 9 A drawing showing numerical values indicating condition of luminance level for each pixel in 1 frame period.
Figure 10:
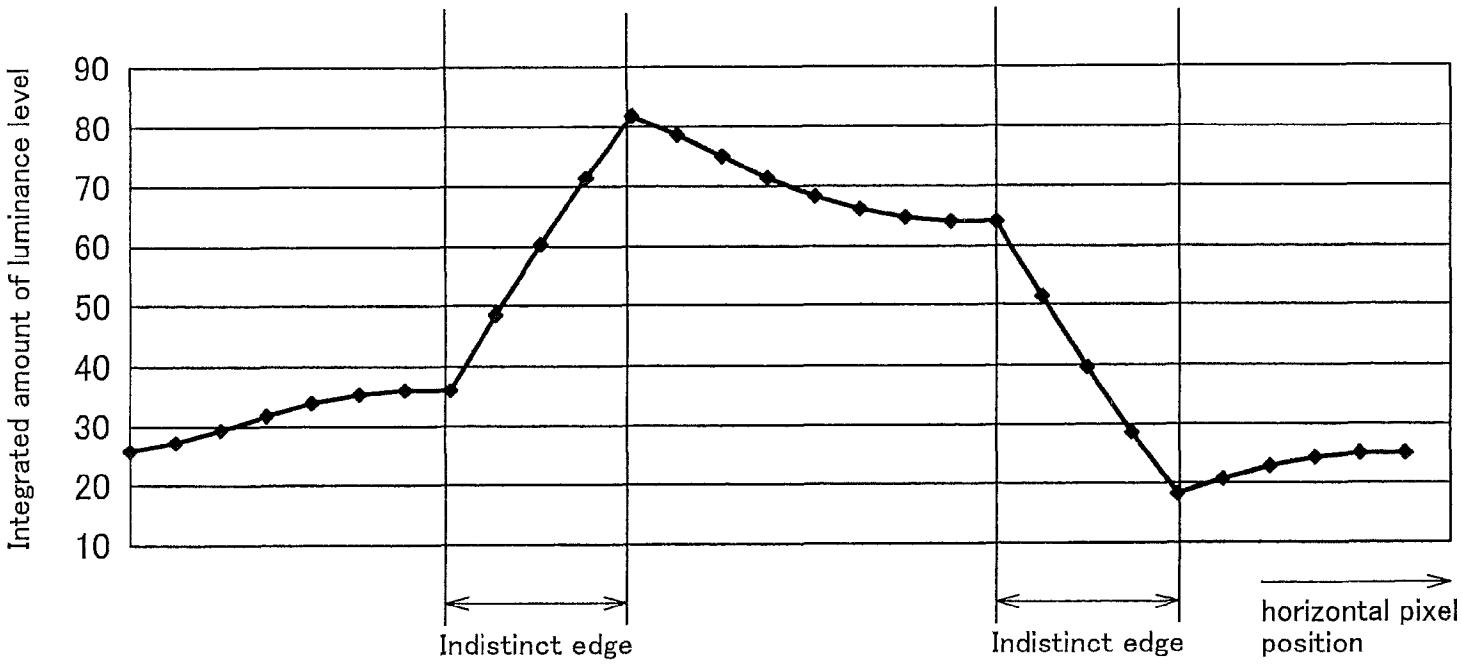
FIG. 10 A drawing showing visible luminance level distribution for an observer following a moving object.
Figure 32:
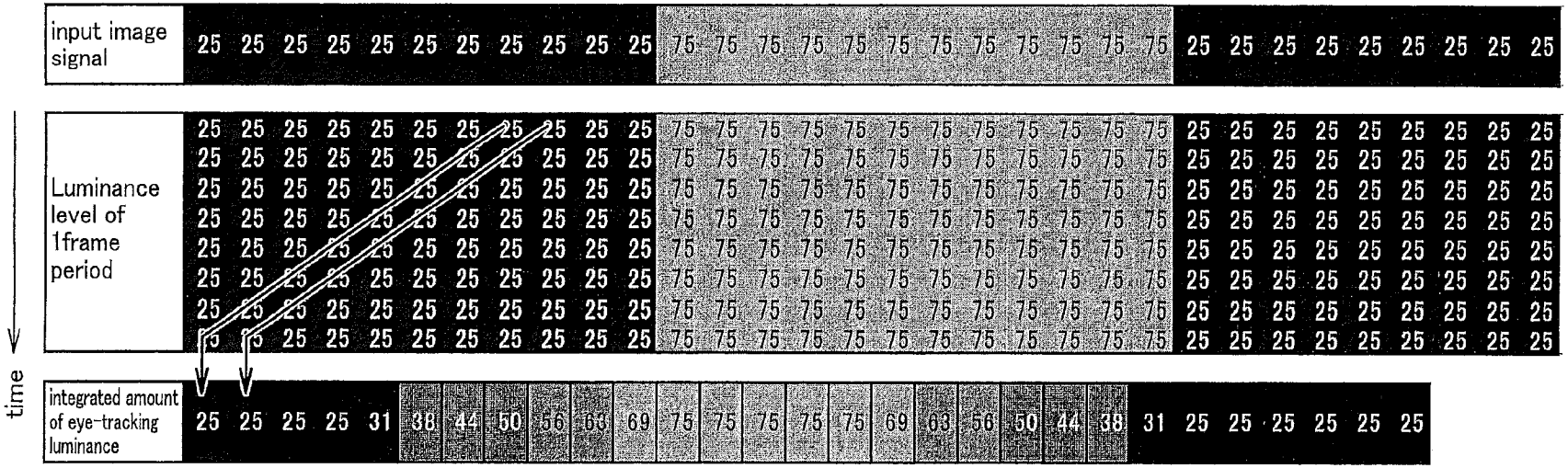
FIG. 32 A drawing showing numerical values indicating condition of luminance level for each pixel in 1 frame period.
Figure 33:
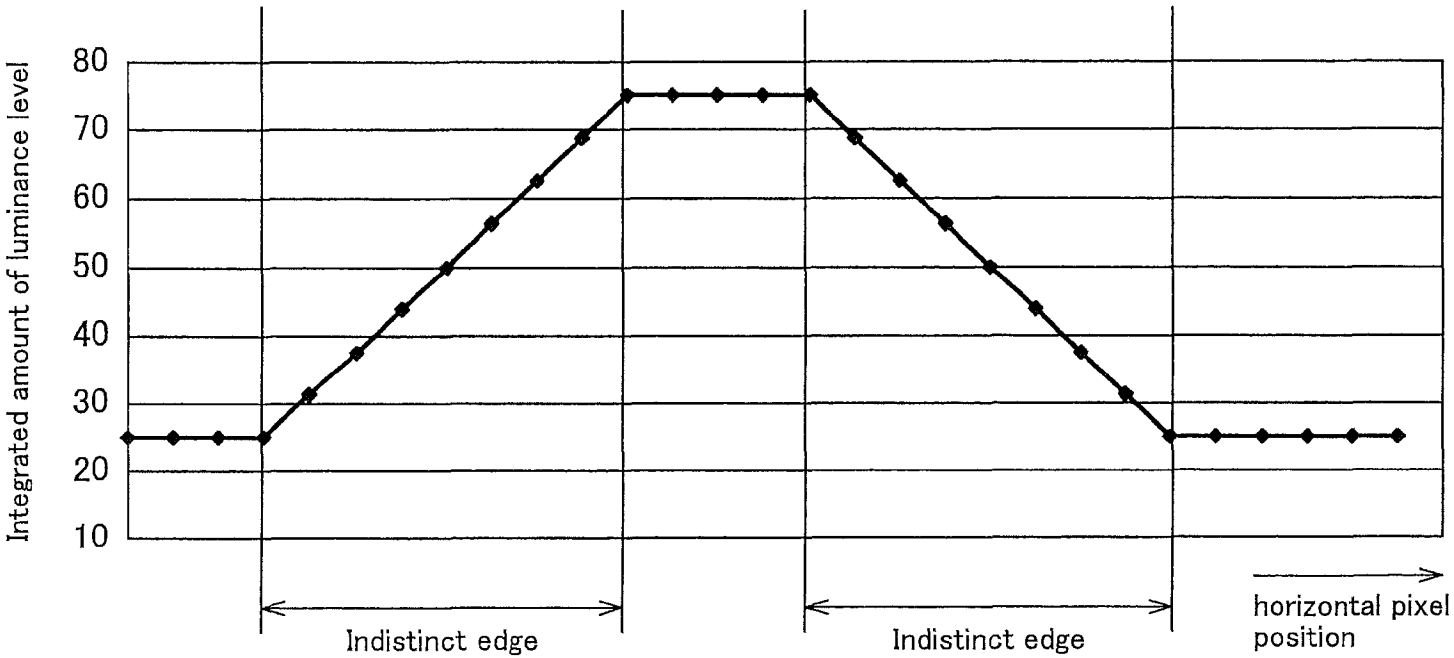
FIG. 33 A drawing showing visible luminance level distribution for an observer following a moving object.

FIG. 9 shows numerical values of the luminance levels of the respective pixels in 1 frame period, in the same manner as with FIG. 32. FIG. 10 shows visible luminance level distribution for an observer following a moving object. In FIG. 10, in the vicinity of the boundary of the respective input luminance levels, it can be seen that the width of the inclined straight line in the horizontal direction is shorter than that in the conventional hold-type display apparatus shown in FIG. 33, even though there is a little change in luminance level in the region supposed to have a stable 25% luminance or 75% luminance. This shows reduction of indistinct edge.

Figure 11:
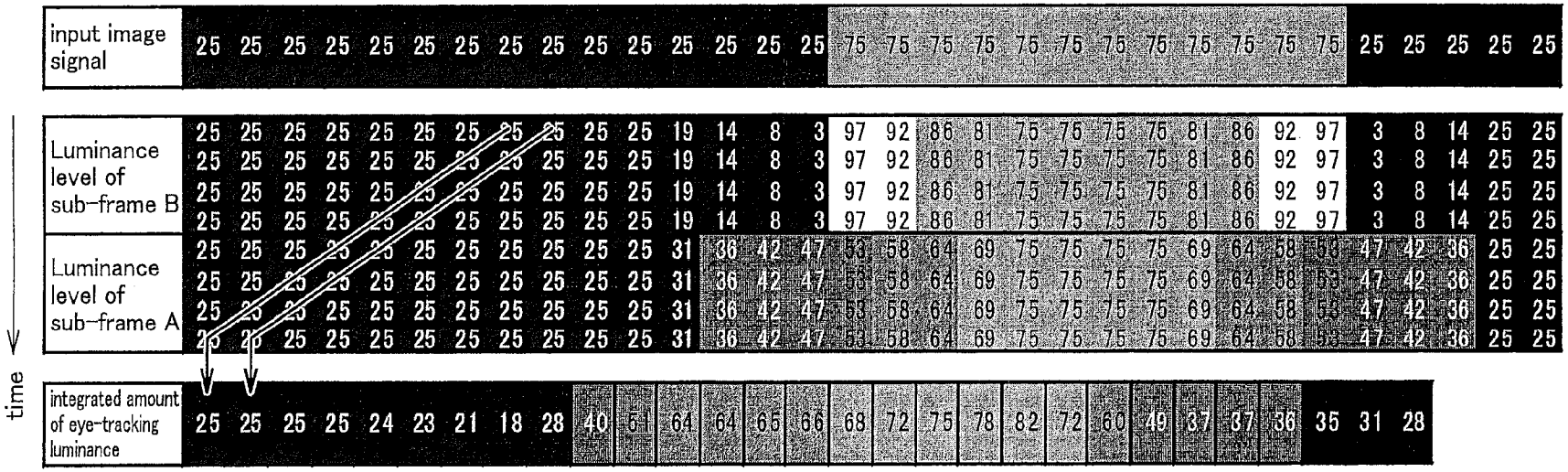
FIG. 11 A drawing showing numerical values indicating condition of luminance level for each pixel in 1 frame period.
Figure 12:
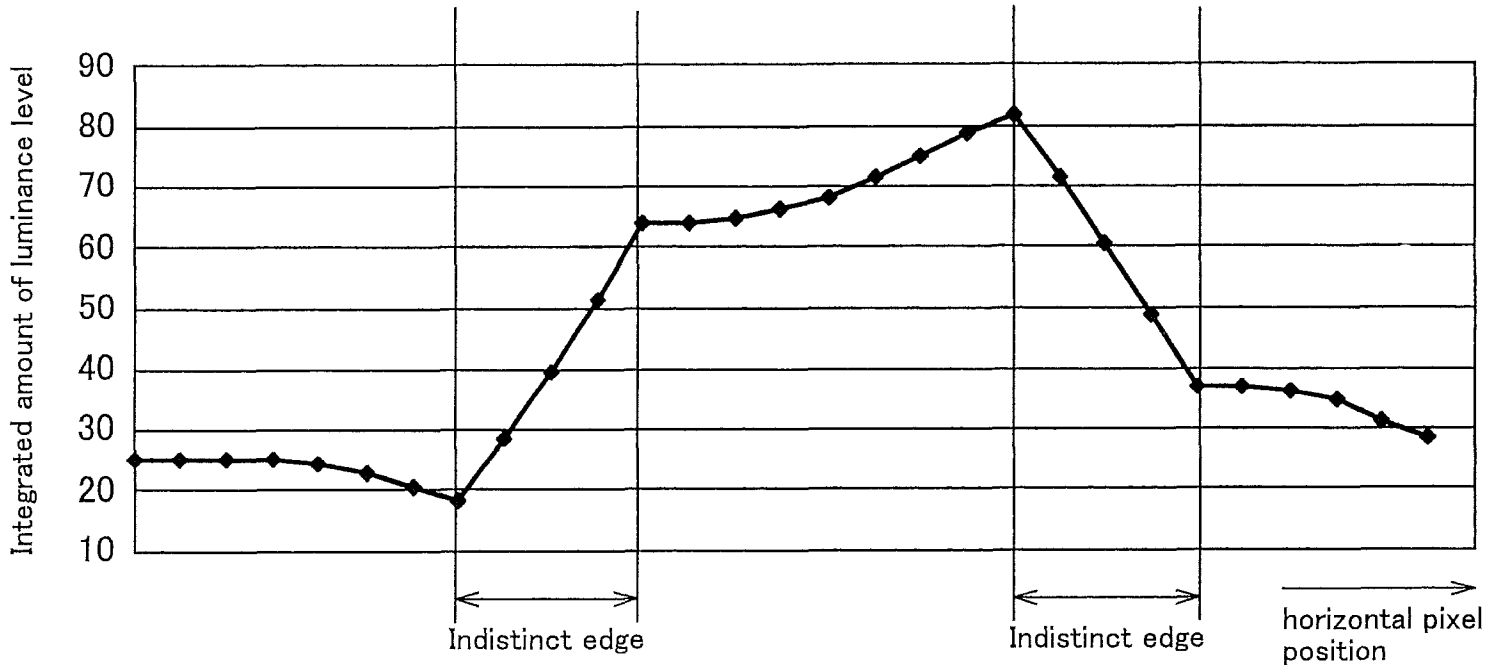
FIG. 12 A drawing showing visible luminance level distribution for an observer following a moving object.

Note that, it is also possible to use an arrangement in which, as with the foregoing example, the frame period is divided into two periods, but the sub-frame B period comes first, and then the sub-frame A period comes next in contrast to the foregoing case. FIGS. 11 and 12 show this arrangement. Figures show that this arrangement also reduces indistinct edge.

Figure 13:
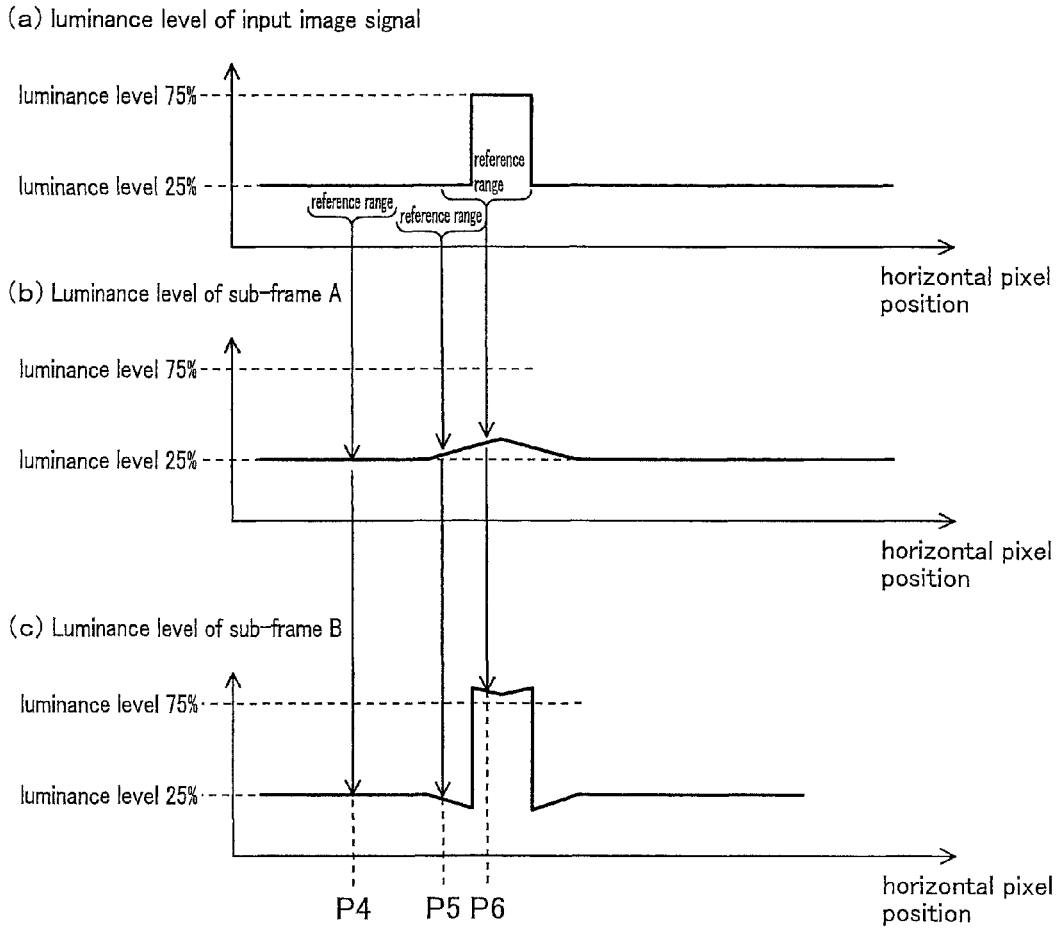
FIG. 13 (*a*) to (*c*) show luminance levels of the respective positions of horizontal pixels. (*a*) shows a luminance level of an input image signal, (*b*) shows a luminance level of a sub-frame A, and (*c*) shows a luminance level of a sub-frame B.
Figure 34:
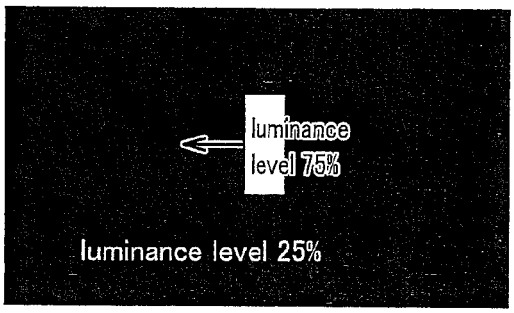
FIG. 34 A drawing showing a state where a 75% luminance region of an image signal moves in the horizontal direction on the background of an image signal whose luminance level is 25%, in the case where the width of the 75% luminance region is smaller than the transition amount on the background 25% in luminance in 1 frame period.
Figure 35:
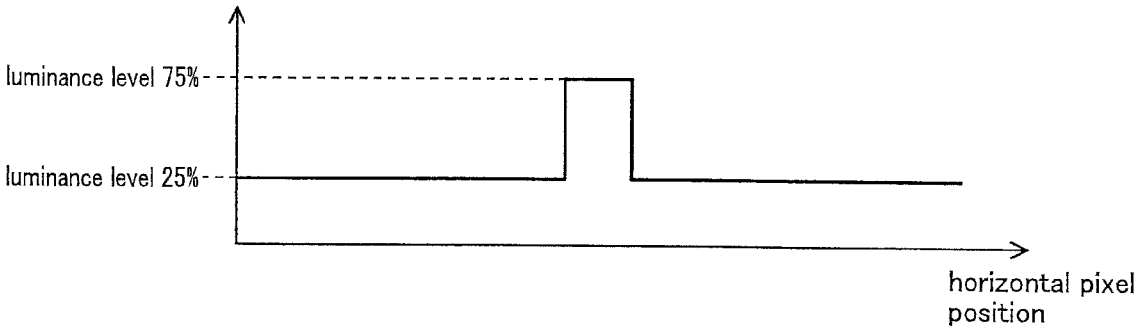
FIG. 35 A drawing showing luminance levels for the respective positions of horizontal pixels.
Figure 36:
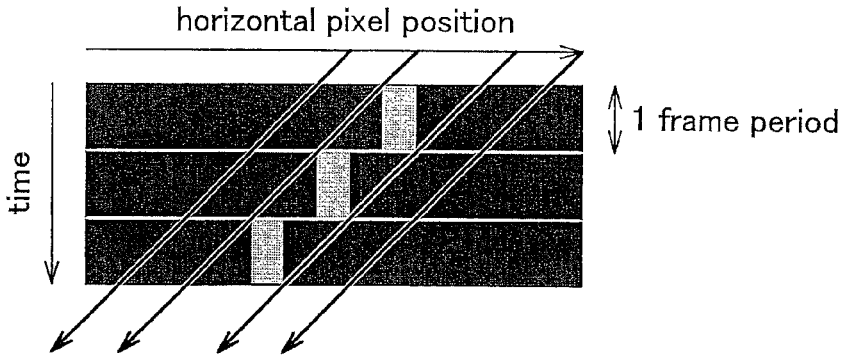
FIG. 36 A drawing showing a time transition of a display luminance distribution in the movement of an image in the horizontal direction.
Figure 37:
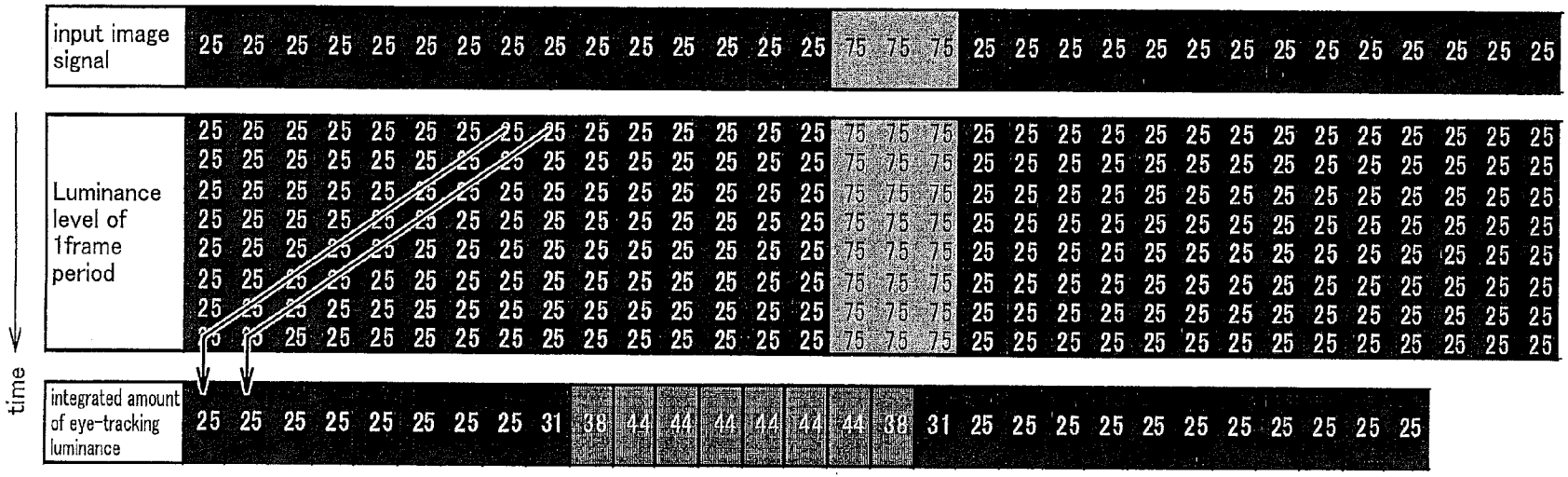
FIG. 37 A drawing showing numerical values indicating condition of luminance level for each pixel in 1 frame period.

Next, as shown in FIG. 34, the following explains a case where the width of the region of 75% luminance region is smaller than the transition amount in the background 25% in luminance level in 1 frame period. With regard to this example, FIG. 13(*a*) shows luminance level distribution with respect to the respective pixels on 1 horizontal line of an image signal supplied to a certain frame. The luminance levels actually shown in the sub-frame A and sub-frame B with respect to such an image signal on an image displaying apparatus are shown in FIG. 13 (*b*) and FIG. 13(*c*).

The following explains display luminance levels at some points on the picture. The point P4 resides in the 25% luminance region of the input signal, and the luminance levels of all pixels in the reference range for generating sub-frame A of the image signal are 25%. Therefore, the luminance level at the point P4 in the sub-frame A period is 25%, and the luminance level in the sub-frame B is also 25% so as to match the luminance level of 1 frame period with the luminance level of the input image signal.

On the other hand, the point P5 resides in a 25% luminance region of the input image signal but the reference range for generating the sub-frame A image signal partly overlaps with a 75% luminance region. To average the image signals in the reference range, the luminance level at the point 5 is greater than 25% and smaller than 75%. On the other hand, to match the luminance level of 1 frame period to the luminance level of the input image signal, the luminance level at the point P5 in the sub-frame B is smaller than 25%.

Similarly, at the point P6, the luminance level of the sub-frame A is smaller than 75%, and greater than 25%, and the luminance level of the sub-frame B is greater than 75%.

FIG. 13(*a*) overlaps with FIG. 7(*a*), and the 75% luminance region of the input image signal is smaller than the width of the reference range. Therefore, particularly, in the 75% luminance region in the input image signal, the luminance level of the sub-frame A is always less than 75% as shown in FIG. 13(*b*), and the luminance level of the sub-frame B is always greater than 75% as shown in FIG. 13(*c*).

Figure 14:
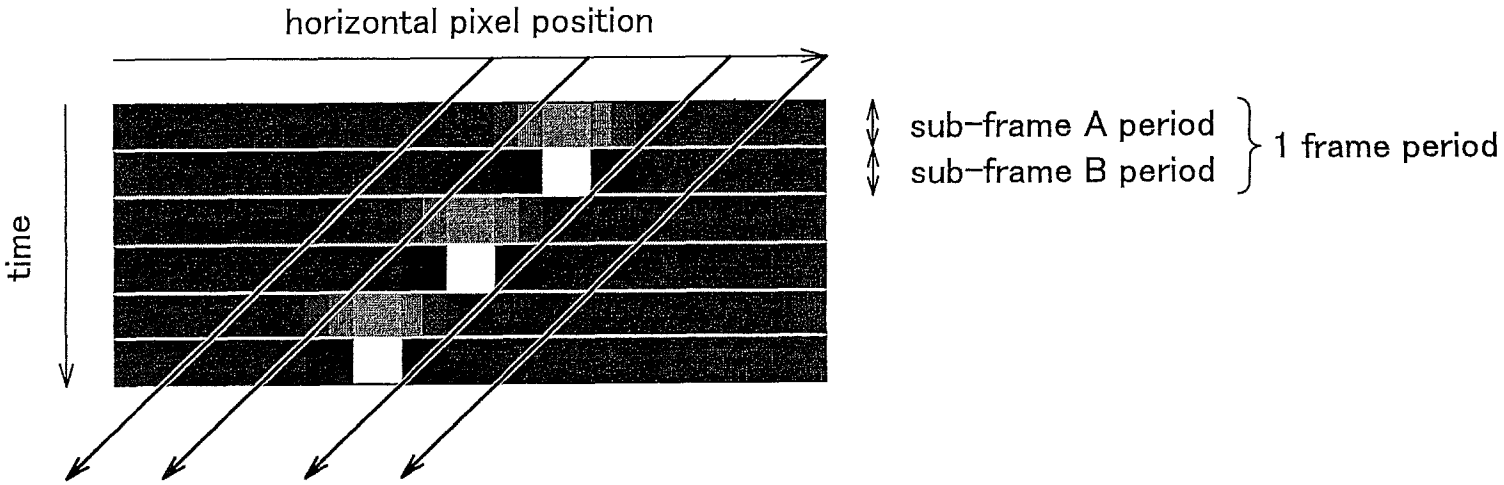
FIG. 14 A drawing showing a time transition of a display luminance distribution on the movement of an image in the horizontal direction.
Figure 15:
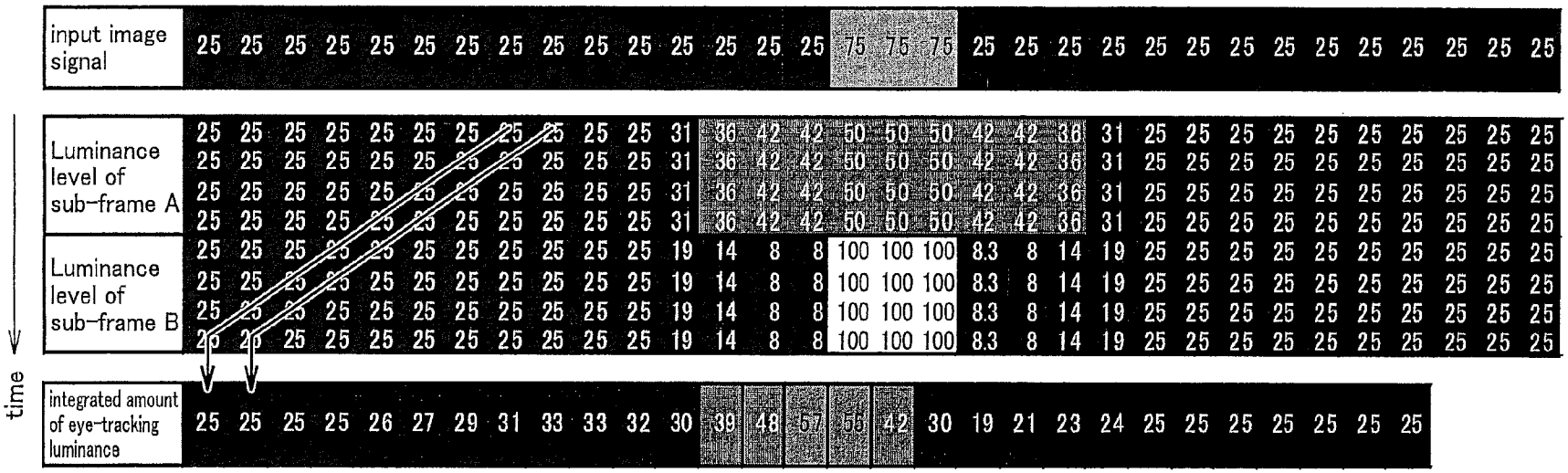
FIG. 15 A drawing showing numerical values indicating condition of luminance level for each pixel in 1 frame period.

FIG. 14 shows time transition of display luminance distribution in the horizontal movement of this image, in the image forming apparatus according to the present embodiment. FIG. 15 is a table of numerical values of luminance levels of the respective pixels on 1 horizontal line in 1 frame period divided into 8 parts.

Figure 16:
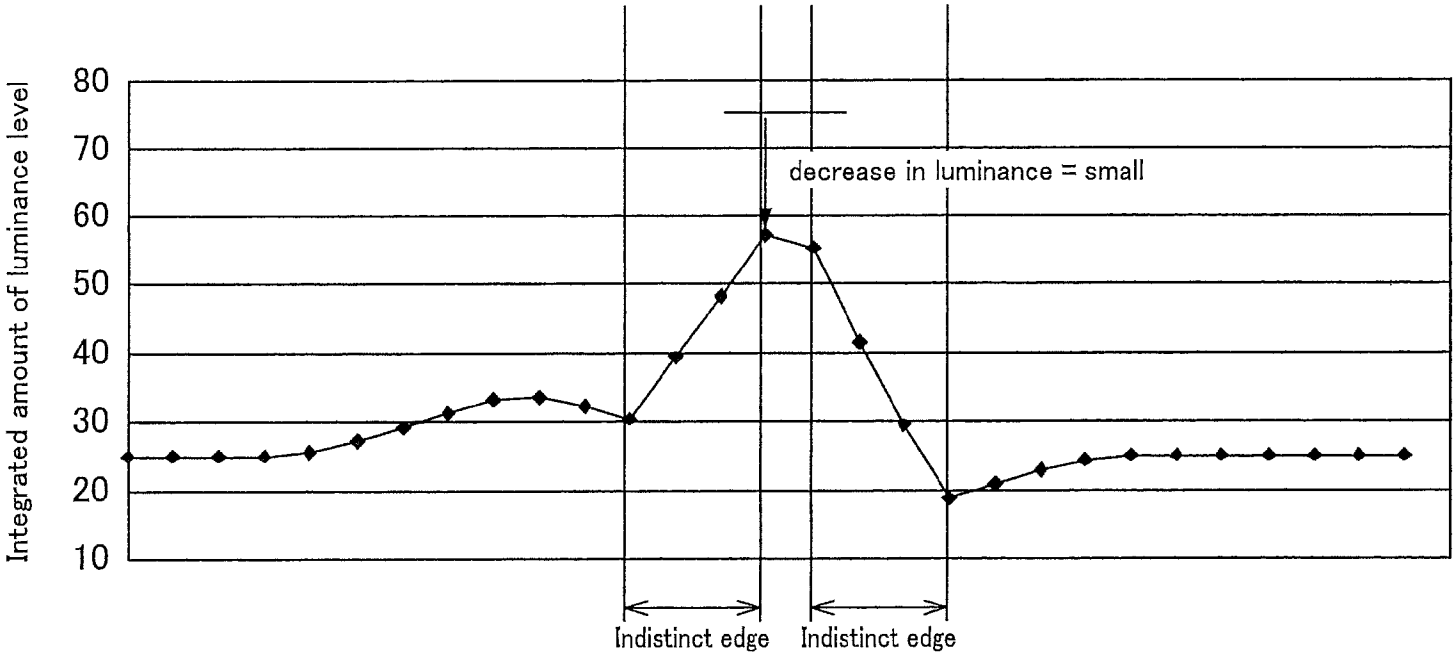
FIG. 16 A drawing showing numerical values indicating condition of luminance level for each pixel in 1 frame period.

FIG. 16 shows visible luminance level distribution for an observer following a moving object. As shown in FIG. 16, compared to the conventional structure of FIG. 38, a little change in luminance level in the region supposed to have a stable 25% and 75% luminance is reduced.

Further, the luminance level of transition region is reduced also in the case where the luminance level of the background is high and the luminance level of the transition region is low, which is inverse to the foregoing example.

In the image displaying apparatus which carries out color display by combining plural original colors such as RGB, it is preferable to separately carry out such a series of operations for each original color.

Second Embodiment

In the present embodiment, the determining method of the sub-frame A and B is the same as that of First Embodiment, but the 1 frame period is divided into 3 sub-frames. The first and the final sub-frames are determined as the sub-frame A, and the middle sub-frames are determined as the sub-frame B. The period length of the sub-frame B is twice a single period of the sub-frame A. The figures to be referred are the same as those in First Embodiment. The difference from First Embodiment is the following block function.

The timing controller 26 divides a 60 Hz input frame period into 3 parts, generates timings of two sub-frame A periods and a single sub-frame B period, and controls a memory controller and a data selector.

The memory controller 21 (1) writes a 60 Hz input image signal into a frame memory, (2) transmits the image signals of 1 frame written into the frame memory to a multi-line memory at a speed according to the sub-frame period. That is, three rounds of the same frame are read out. The processes (1) and (2) are carried out concurrently in a time-divisional manner.

The method of generating the sub-frame A and the sub-frame B in the present embodiment is the same as that of First Embodiment, as shown in FIG. 7(*b*) and FIG. 7(*c*).

Figure 17:
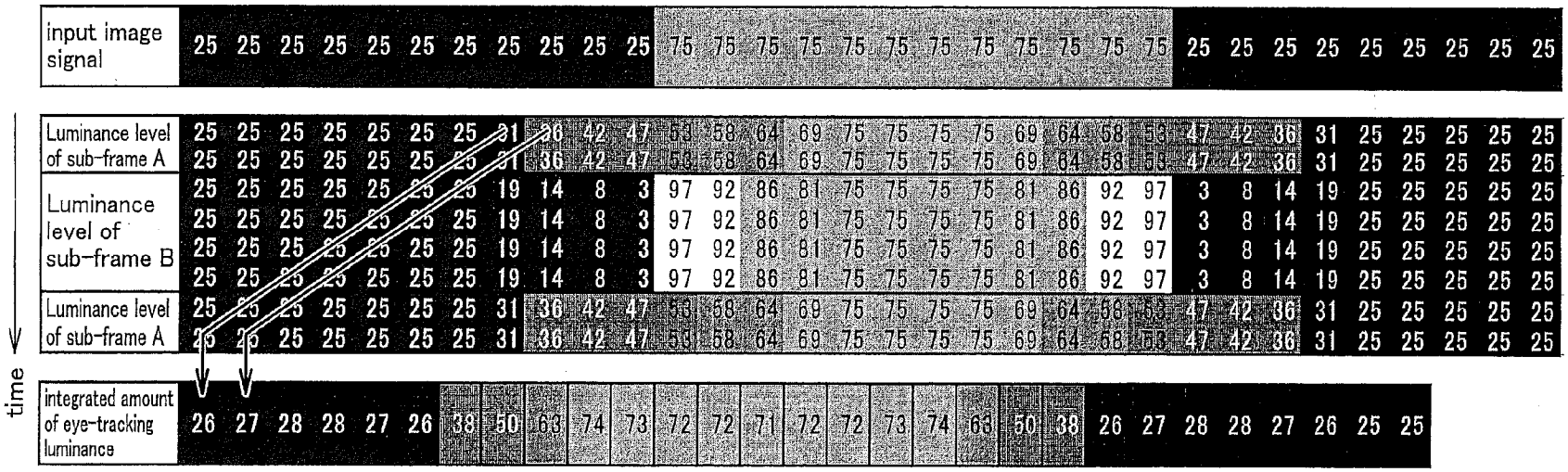
FIG. 17 A drawing showing numerical values indicating condition of luminance level for each pixel in 1 frame period.
Figure 18:
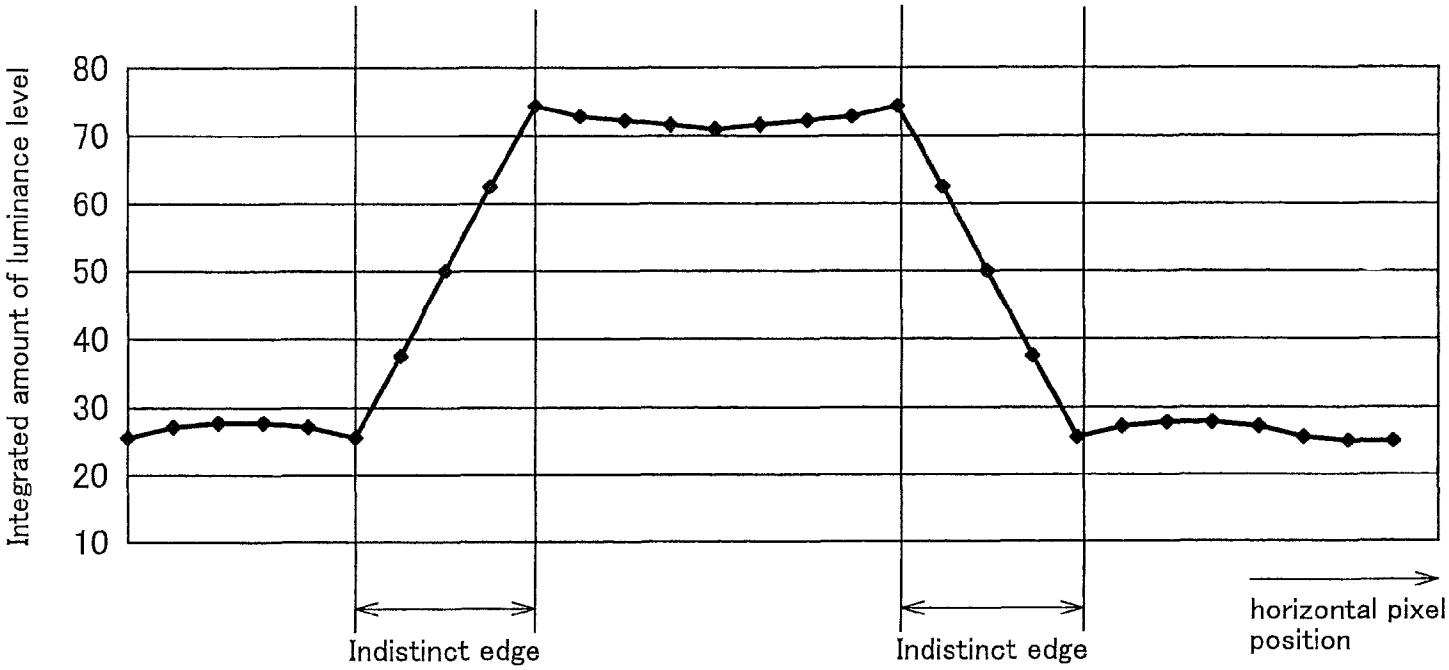
FIG. 18 A drawing showing visible luminance level distribution for an observer following a moving object.

FIG. 17 shows numerical values denoting the condition of luminance levels in the respective pixels in 1 frame period, and FIG. 18 shows visible luminance level distribution for an observer following a moving object. In FIG. 18, in the vicinity of the boundary of the respective input luminance levels, it can be seen that the indistinct edge is less significant than that in the conventional hold-type display apparatus shown in FIG. 33 to the same degree as that of First Embodiment. Further, the figure shows that the shape of the luminance distribution in the vicinity of the two horizontal edges of the moving object is symmetrical. That is to say, by equalizing the change in luminance level in the vicinity of the boundary of the two display luminances regardless of the moving direction, it is possible to reduce visible discomfort of the observer.

Third Embodiment

In the present embodiment, in displaying the Nth frame, a virtual sub-frame M is generated as an estimated value based on the image signal of the input (N−1)th frame and the input Nth frame. The virtual sub-frame M resides in the middle time point between the input (N−1)th frame and the input Nth frame. The display 1 frame period is divided into the two sub-frames identical in period length, one of which is a sub-frame A period in which a mean image signal of pixels in a certain range in the vicinity of the target pixel of the virtual sub-frames M is outputted, and the other is a sub-frame B period in which an image signal for emphasizing the difference between the input image signal of the target pixel and the mean input image signal of the Nth frame input image signals to the pixels within the reference range in the vicinity of the target pixel is outputted.

Figure 19:
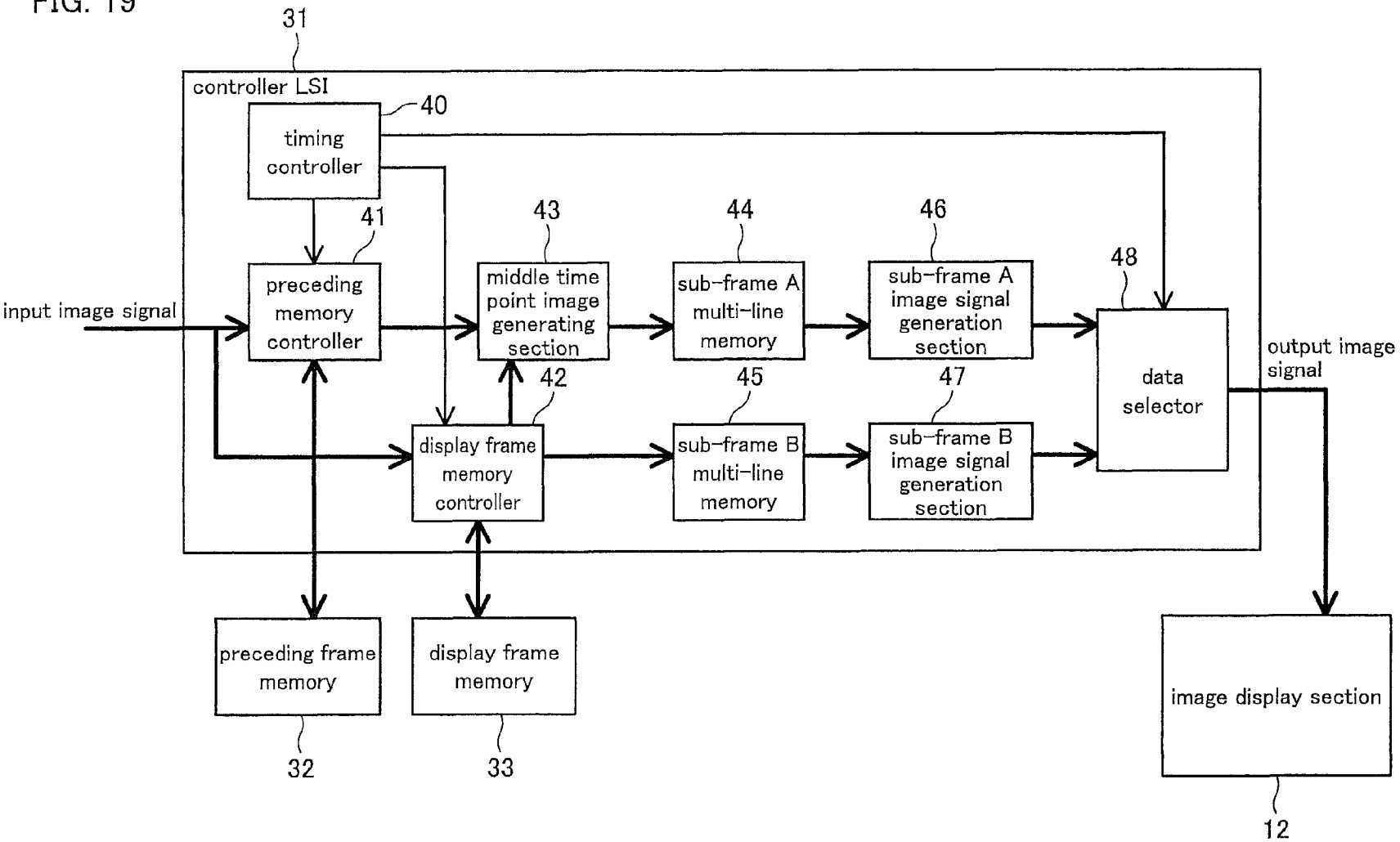
FIG. 19 A block diagram showing a structure example of an image displaying apparatus.

FIG. 19 shows a structure of the image displaying apparatus. In this image displaying apparatus, a controller LSI31 is connected to an image display section 12, such as a liquid crystal panel, a preceding frame memory 32 and a display frame memory 33. The controller LSI31 includes a timing controller 40, a preceding memory controller 41, a display frame memory controller 42, a middle time point image generating section 43, a sub-frame A multi-line memory 44, a sub-frame B multi-line memory 44, a sub-frame A image signal generation section 46, a sub-frame B image signal generation section 47, and a data selector 48.

The timing controller 40 generates timings of a sub-frame A period and a sub-frame B period which are two divisional periods of a 60 Hz input frame period, so as to control the preceding frame memory controller 41, the display frame memory controller 42 and the data selector 25.

The preceding frame memory controller 41 (1) writes a 60 Hz input image signal into the preceding frame memory, and (2) continuously reads out a frame image signal of a preceding frame of the frame read out by the display frame memory controller having been written into the preceding frame memory according to the timing of the sub-frame A period and transmits the frame image signal to the middle time point image generating means. The processes (1) and (2) are carried out concurrently in a time-divisional manner.

The display frame memory controller 42 (1) writes a 60 Hz input image signal into the display frame memory, and (2) continuously reads out a frame image signal of a following frame of the frame read out by the preceding frame memory controller having been written into the display frame memory according to the timing of the sub-frame A period and the sub-frame B period and transmits the frame image signal to the middle time point image generating means and the sub-frame B multi-line memory. Two rounds of the image signals in the same frame are read out. The processes (1) and (2) are carried out concurrently in a time-divisional manner.

The middle time point image generating section 43 generates an estimated virtual middle time point frame image (Frame M) based on the image signal of the preceding frame and the image signal of the display frame. For example, this may be performed by a method of (i) comparing the image signals in a certain range of the display frame with the image signals in a plurality of certain ranges of the preceding frame, (ii) determining that a certain range of the preceding frame having the smallest gross level difference from the level of the image signal of the certain range of the display frame moves to the certain range of the display frame, (iii) generating, for the entire frame, estimated images for moving the certain range by a ½ of the transition amount as a middle time point frame image. However, even in this method, it is difficult to generate accurate middle time point images, and there is a possibility of partial image noise due to estimation error. Note that, the method of generating the middle time point images is not particularly limited in the present invention.

The sub-frame A/B multi-line memories 44 and 45 hold image signals of Y line including the horizontal line currently displayed.

The sub-frame B image signal generation section 47 supplies image signals for a horizontal X pixel including a target pixel and for a vertical Y-line through a sub-frame B multi-line memory, and sets a range of X pixel×Y pixel to be used as a reference range. The mean value of the image signal levels of the respective pixels in this range is calculated. Next, a sub-frame B image signal for the target pixel is generated so that the time integrated amount of a luminance level of a virtual 1 frame period constituted of the mean value and the image signal of the sub-frame B corresponds to a luminance level of an input image signal. The resulting sub-frame B image signal has a larger difference between the input image signal of the target pixel and a mean value of the input image signals of the respective pixels in the reference range. However, in the case where the integrated amount of the luminance is larger than the luminance level of the input image signal even when the sub-frame B image signal is the smallest image signal, the sub-frame B image signal is determined to be the smallest image signal. Similarly, in the case where the integrated amount of the luminance is smaller than the luminance level of the input image signal even when the sub-frame B image signal is the largest image signal, the sub-frame B image signal is determined to be the largest image signal.

The sub-frame A image signal generation section 46 supplies image signals for a horizontal X pixel including a target pixel and for a vertical Y-line of the virtual sub-frame M through a sub-frame A multi-line memory, and sets a range of X pixel×Y pixel to be used as a reference range. The mean value of the image signal levels of the respective pixels in this range is calculated to set a sub-frame A image signal.

At this time, if the constant accordance of the displayed luminance level with the luminance level of the input image signal is more important than improvement in moving picture quality, the emphasis image signal with respect to the target pixel is generated so that the time integrated amount of display luminance in a virtual 1 frame period constituted of the mean value and the emphasized value of the image signal corresponds to the luminance level of image signal of the target pixel in the virtual sub-frames M. In the case where the integrated amount of the luminance is larger than the luminance level of the virtual sub-frames M image signal even when the emphasis image signal is the smallest image signal, the sub-frame A image signal is set so that the integrated amount of the luminance of the minimum image signal and the sub-frame A image signal becomes identical to the luminance level of the virtual sub-frames M image signal. Similarly, in the case where the integrated amount of the luminance is smaller than the luminance level of the virtual sub-frames M image signal even when the emphasis image signal is the largest image signal, the sub-frame A image signal is set so that the integrated amount of the luminance of the maximum image signal and the sub-frame A image signal becomes identical to the luminance level of the virtual sub-frames M image signal.

More specifically, the sub-frame A of Third Embodiment derives from the virtual sub-frames M, but in the case of a still picture, the virtual sub-frames M should almost identical to the input frame. If the assurance of display luminance accurately corresponding to the luminance level of a still picture (virtual sub-frames M which coincides with a still picture) is more important, the emphasis calculation is carried out for the sub-frame A in the same manner as that of the sub-frame B before the image signal is found, so as to find out whether the emphasized value falls outside the maximum value or the minimum value. With this process, the resulting sub-frame A constituted of the emphasized value and the sub-frame A allows display of luminance accurately corresponding to the virtual sub-frames M, even when the emphasized value falls outside the maximum value or the minimum value.

Note that, if the constant accordance of the displayed luminance level with the luminance level of the input image signal is more important than improvement in moving picture quality, the foregoing process is not necessary.

The data selector 48 selects either of the sub-frame A image signal and the sub-frame B image signal according to the current display sub-frame phase, and transmits the selected signal to the image display section 12.

The display luminance level of the sub-frame B period according to the present embodiment is totally the same as that of First Embodiment. On the other hand, as to the sub-frame A period, in contrast to First Embodiment using an input image signal to determine the luminance level, the present embodiment uses a middle time point virtual frame image signal which is generated by estimation based on two frame image signals subsequently supplied.

With regard to 1 horizontal line in a picture in the case where a region of an image signal 75% in luminance level moves in the horizontal direction on a background of an image signal 25% in luminance level as shown in FIG. 29, FIG. 40(*a*) shows luminance level distribution of an input image signal of the (N−1)th frame, and FIG. 40(*b*) shows luminance level distribution of an input image signal of the Nth frame. In this case, it is difficult to estimate an image signal between the two frames with perfect accuracy, and therefore defective operation due to estimation error is always possible. The following explains an error as with the conventional FIG. 40 (*d*) in which a middle time point virtual frame is simply inserted.

Figure 20:
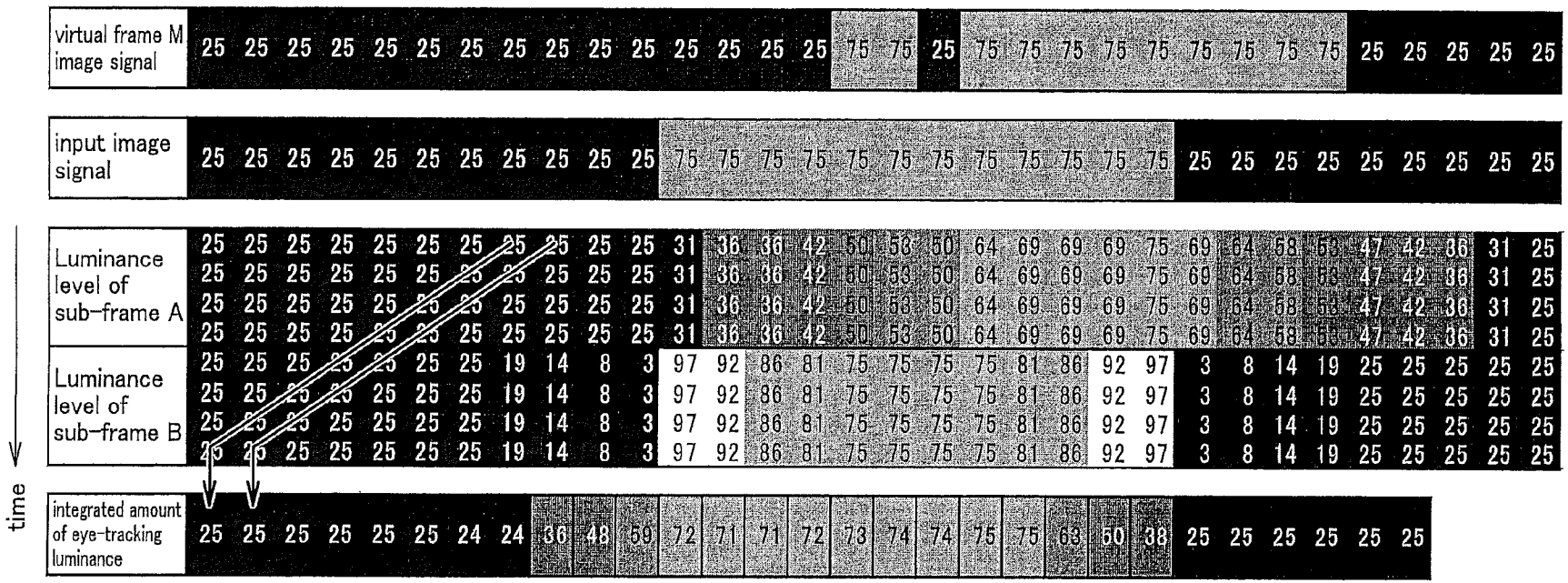
FIG. 20 A drawing showing numerical values indicating condition of luminance level for each pixel in 1 frame period.
Figure 21:
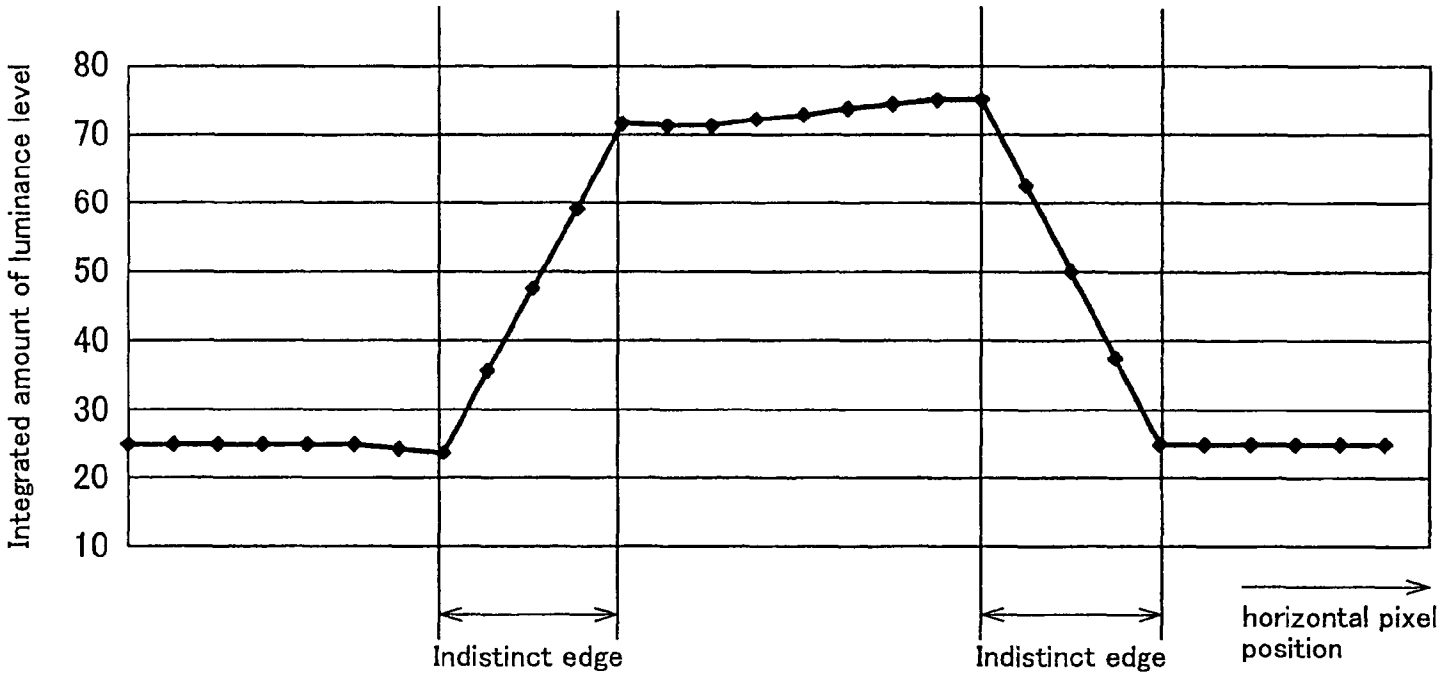
FIG. 21 A drawing showing visible luminance level distribution for an observer following a moving object.
Figure 42:
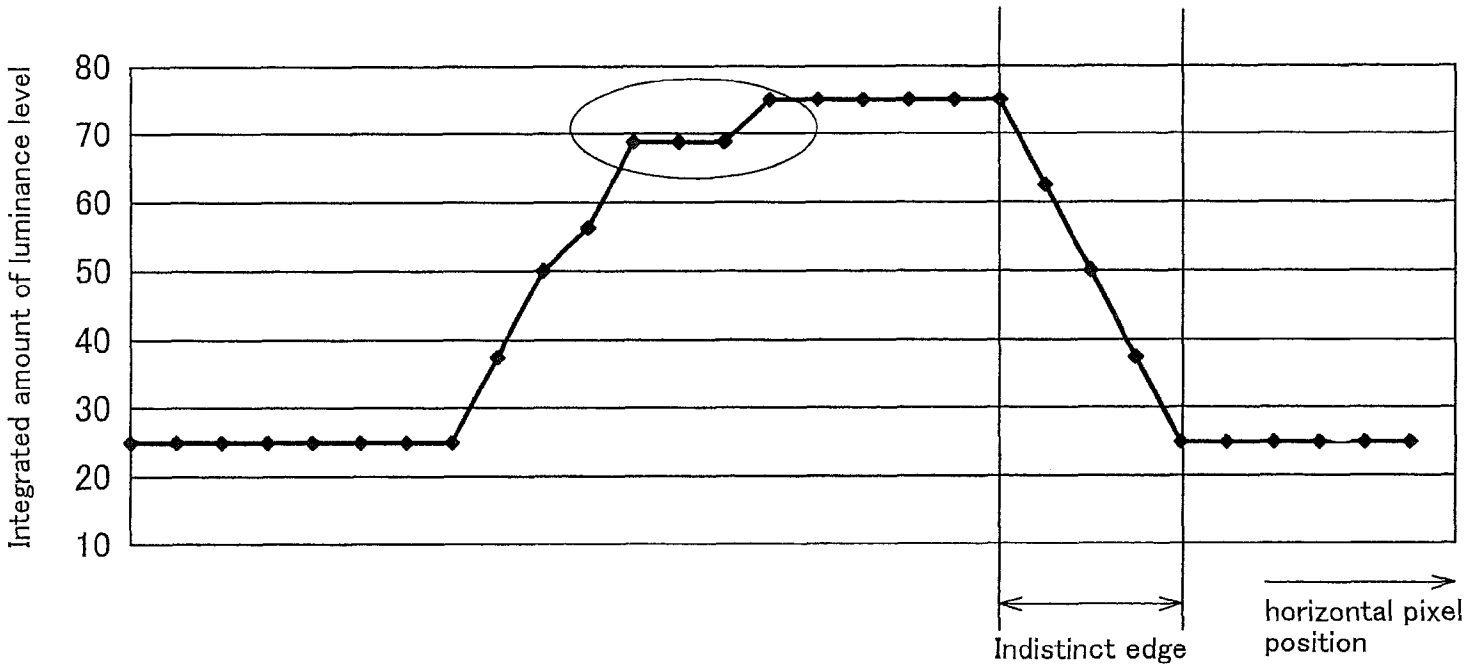
FIG. 42 A drawing showing visible luminance level distribution for an observer following a moving object.

FIG. 20 shows numerical values indicating condition of luminance level of the sub-frame B generated in the same manner as that of First Embodiment in 1 frame period when such an error occurs in a virtual frame in the middle time point. On the other hand, FIG. 21 shows a distribution of integral amount of visible luminance level for an observer following a moving object. In this example, the estimation error of a virtual frame does not occur in the vicinity of the right edge of the 75% luminance region, and the distribution of integrated amount of luminance level is proper. The degree of the indistinct edge is almost the same as that of the method of FIG. 42 in which a virtual frame image is simply inserted.

On the other hand, there is a slight error in the distribution waveform of the integrated amount of the luminance level in the vicinity of the left edge of the 75% region due to an estimation error. However, such a level difference of distribution waveform in FIG. 42 in which a virtual frame image is simply inserted is not seen. This shows improvement in picture quality.

Fourth Embodiment

The present embodiment is structured to use a preceding frame and a frame (virtual sub-frame Q) of a mean image signal of the display frame instead of middle time point frame (virtual sub-frames M) of Third Embodiment.

The present embodiment is identical to Third Embodiment except for the followings.

In displaying the Nth frame, the present embodiment uses a virtual sub-frame Q in which each pixel has an image signal level which is a mean image signal level of the image signal levels of the pixels of the input (N−1)th frame and the input Nth frame. The display 1 frame period is divided into the two sub-frames identical in period length, one of which is a sub-frame A period in which a mean image signal of pixels in a certain range in the vicinity of the target pixel of the virtual sub-frames Q is outputted, and the other is a sub-frame B period in which an image signal for emphasizing the difference between the input image signal of the target pixel and the mean input image signal of the Nth frame input image signals to the pixels within the reference range in the vicinity of the target pixel is outputted.

Figure 22:
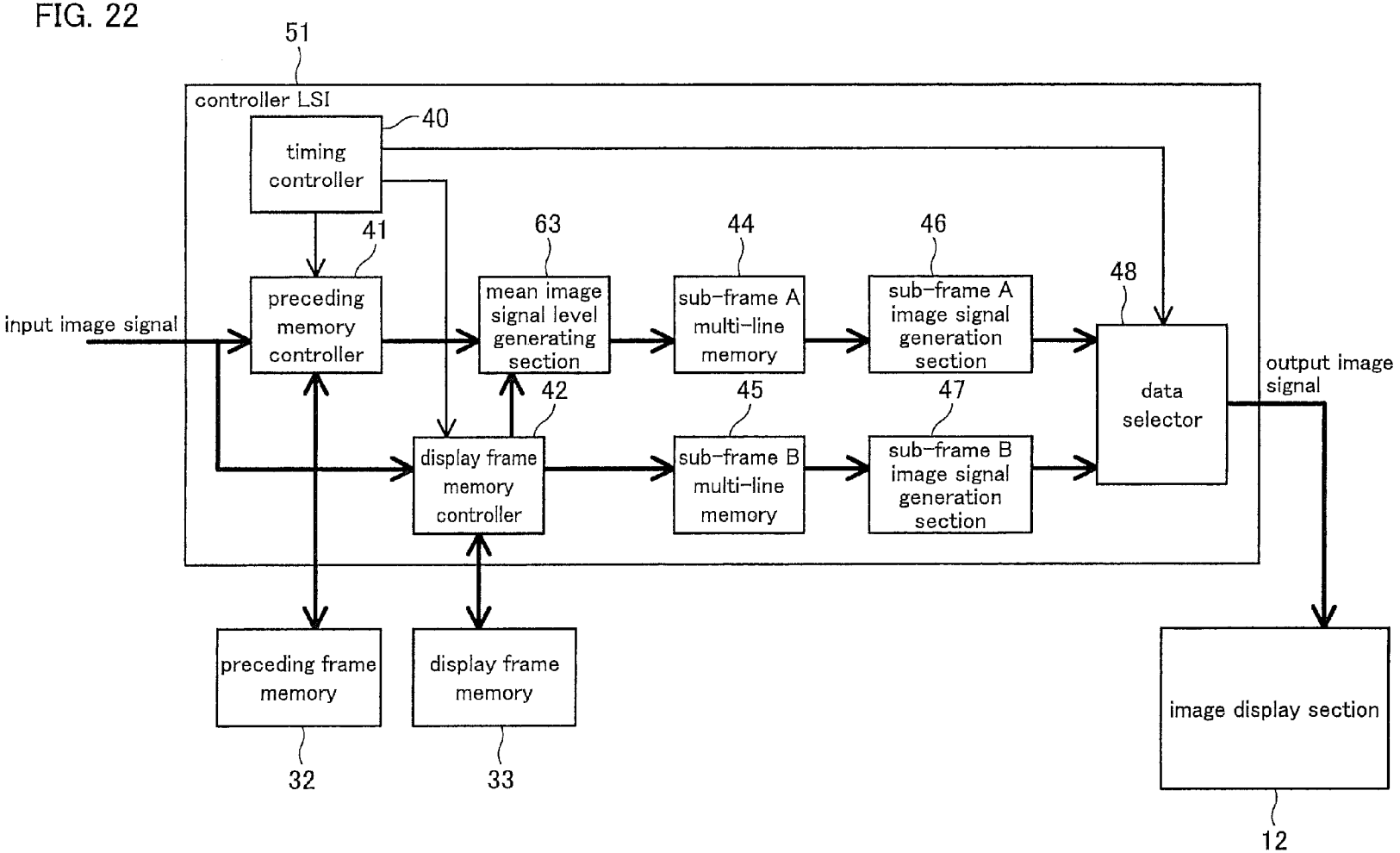
FIG. 22 A block diagram showing a structure example of an image displaying apparatus.

FIG. 22 shows a structure of the image displaying apparatus of the present embodiment. In this image displaying apparatus, a controller LSI31 is connected to an image display section 12, such as a liquid crystal panel, a preceding frame memory 32 and a display frame memory 33. The controller LSI31 includes a timing controller 40, a preceding memory controller 41, a display frame memory controller 42, a mean image signal level generation section 63, a sub-frame A multi-line memory 44, a sub-frame B multi-line memory 44 a sub-frame A image signal generation section 46, a sub-frame B image signal generation section 47, and a data selector 48.

The mean image signal level generation section 63 calculates a mean value of an image signal level of a preceding frame of a given pixel and an image signal level of the display frame of said pixel using a calculation circuit or software, and outputs the calculation result as an image signal level of the virtual sub-frame Q.

The sub-frame A image signal generation section 46 supplies image signals for a horizontal X pixel including a target pixel and for a vertical Y-line of the virtual sub-frame Q through the sub-frame A multi-line memory, and sets a range of X pixel×Y pixel to be used as a reference range. The mean value of the image signal levels of the respective pixels in this range is calculated to set a sub-frame A image signal.

At this time, if the constant accordance of the displayed luminance level with the luminance level of the input image signal is more important than improvement in moving picture quality, the emphasis image signal with respect to the target pixel is generated so that the time integrated amount of display luminance in a virtual 1 frame period constituted of the mean value and the emphasized value of the image signal corresponds to the luminance level of image signal of the target pixel in the virtual sub-frames Q. In the case where the integrated amount of the luminance is larger than the luminance level of the virtual sub-frames Q image signal even when the emphasis image signal is the smallest image signal, the sub-frame A image signal is set so that the integrated amount of the luminance of the minimum image signal and the sub-frame A image signal becomes identical to the luminance level of the virtual sub-frames Q image signal. Similarly, in the case where the integrated amount of the luminance is smaller than the luminance level of the virtual sub-frames Q image signal even when the emphasis image signal is the largest image signal, the sub-frame A image signal is set so that the integrated amount of the luminance of the maximum image signal and the sub-frame A image signal becomes identical to the luminance level of the virtual sub-frames Q image signal.

The display luminance level of the sub-frame B period according to the present embodiment is totally the same as that of First Embodiment. On the other hand, as to the sub-frame A period, in contrast to First Embodiment using an input image signal to determine the luminance level, the present embodiment uses a virtual frame image signal which is a mean value of the respective pixels of the two frame image signals subsequently supplied.

Figure 23:
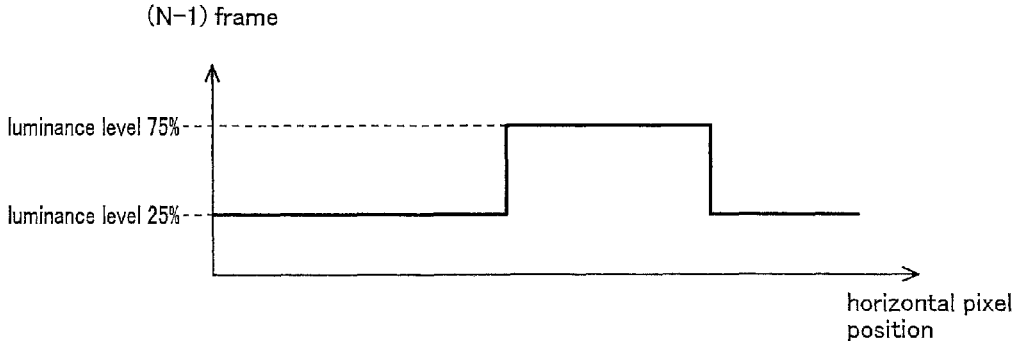
FIG. 23(*a*) A drawing showing luminance levels for the respective positions of horizontal pixels in the (N−1)th frame.
Figure 23:
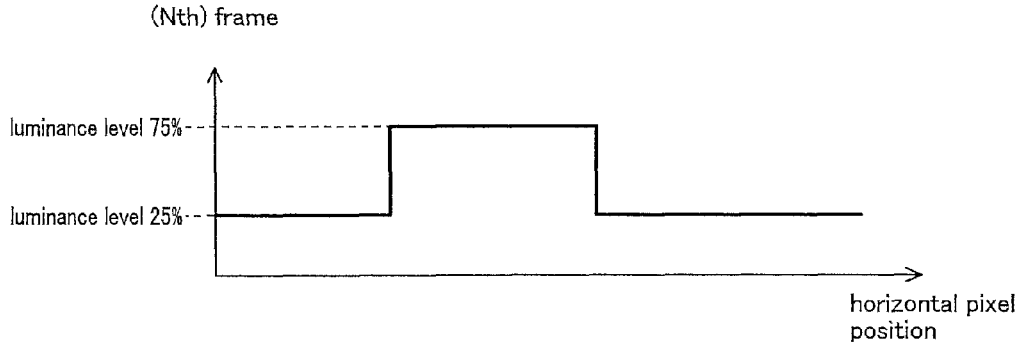
Figure 23:
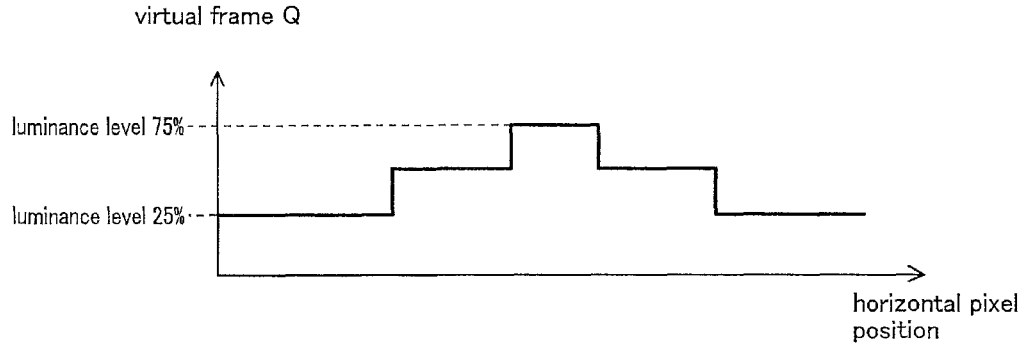

With regard to 1 horizontal line in a picture in the case where a region of an image signal 75% in luminance level moves in the horizontal direction on a background of an image signal 25% in luminance level as shown in FIG. 29, FIG. 23(*a*) shows luminance level distribution of an input image signal of the (N−1)th frame, and FIG. 23(*b*) shows luminance level distribution of an input image signal of the Nth frame. FIG. 23(*c*) shows luminance level distribution on 1 horizontal line of a virtual sub-frame Q constituted of a image signal level which is a mean value of the input image signal levels of the respective pixels of the Nth frame and the (N−1)th frame.

Figure 24:
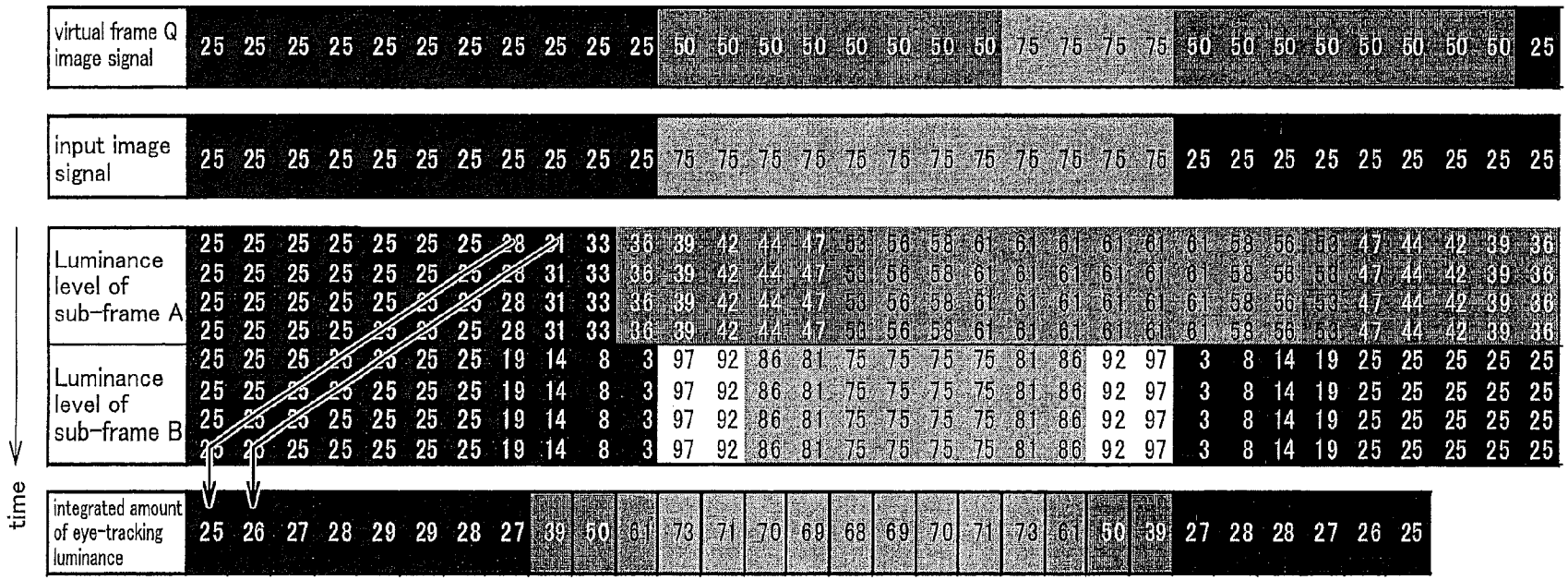
FIG. 24 A drawing showing numerical values indicating condition of luminance level for each pixel in 1 frame period.
Figure 25:
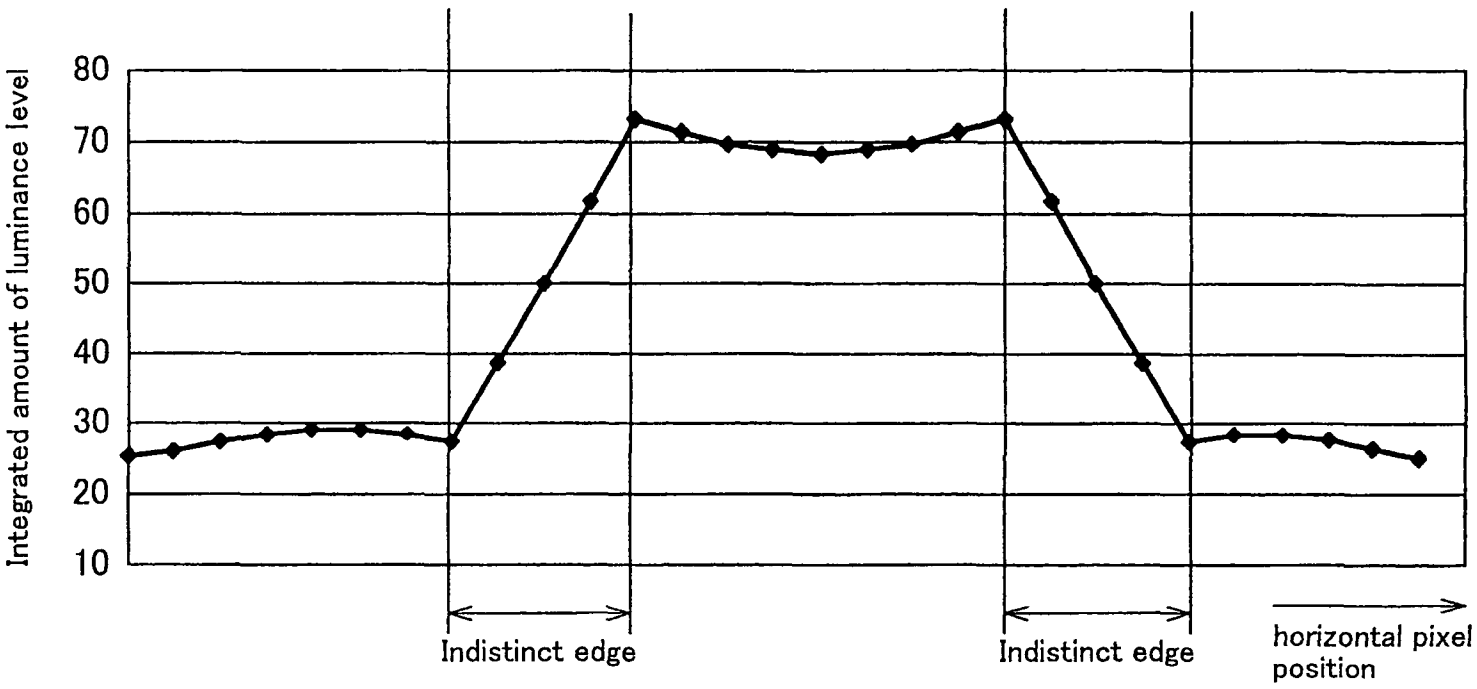
FIG. 25 A drawing showing visible luminance level distribution for an observer following a moving object.

FIG. 24 shows numerical values denoting the condition of luminance levels in the respective pixels in 1 frame period with respect to the input image signal, and FIG. 25 shows visible luminance level distribution for an observer following a moving object. In FIG. 25, in the vicinity of the boundary of the respective input luminance levels, it can be seen that the indistinct edge is less significant than that in the conventional hold-type display apparatus shown in FIG. 33 to the same degree as that of First Embodiment.

Further, the figure shows that the shape of the luminance distribution in the vicinity of the two horizontal edges of the moving object is symmetrical. That is to say, by equalizing the change in luminance level in the vicinity of the boundary of the two display luminances regardless of the moving direction, it is possible to reduce visible discomfort of the observer.

Figure 26:
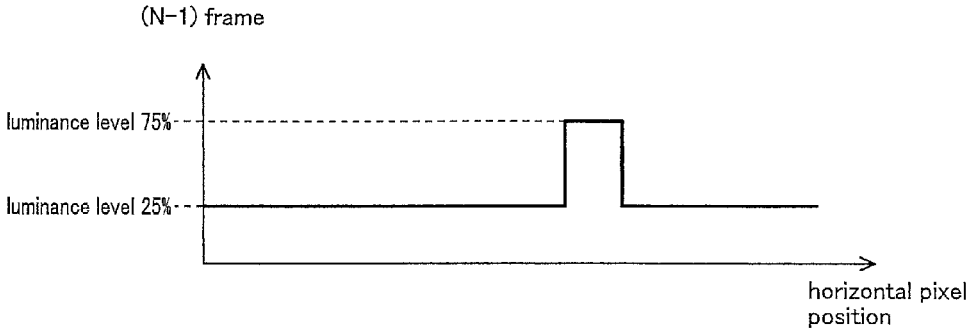
FIG. 26(*a*) A drawing showing luminance levels for the respective positions of horizontal pixels in the (N−1)th frame.
Figure 26:
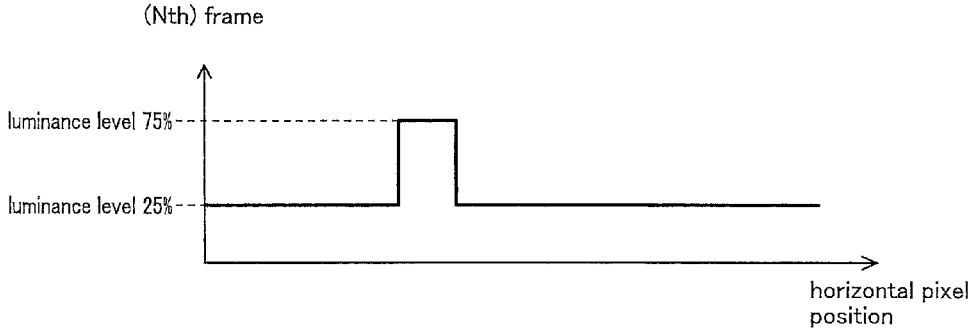
Figure 26:
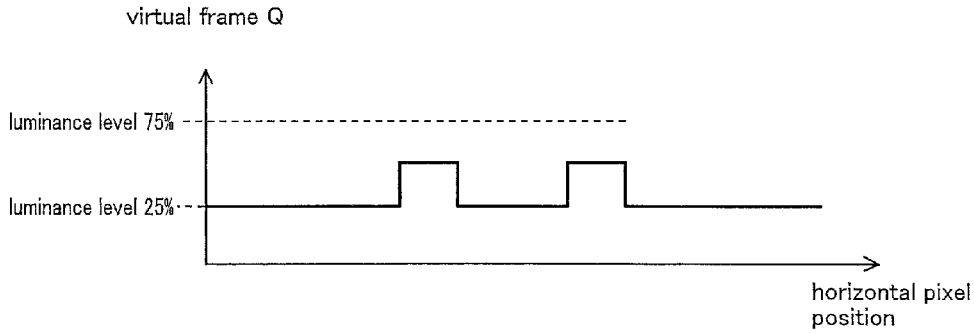

Next, as shown in FIG. 34, the following explains a case where the width of the region of 75% luminance region is smaller than the transition amount of the luminance level 25% in 1 frame period. Regarding this example, FIG. 26(*a*) shows luminance level distribution of an image signal supplied to the (N−1)th frame, and FIG. 26(*b*) shows luminance level distribution of an image signal supplied to the Nth frame. FIG. 26(*c*) shows luminance level distribution on 1 horizontal line of a virtual sub-frame Q constituted of a image signal level which is a mean value of the input image signal levels of the respective pixels of the Nth frame and the (N−1)th frame.

Figure 27:
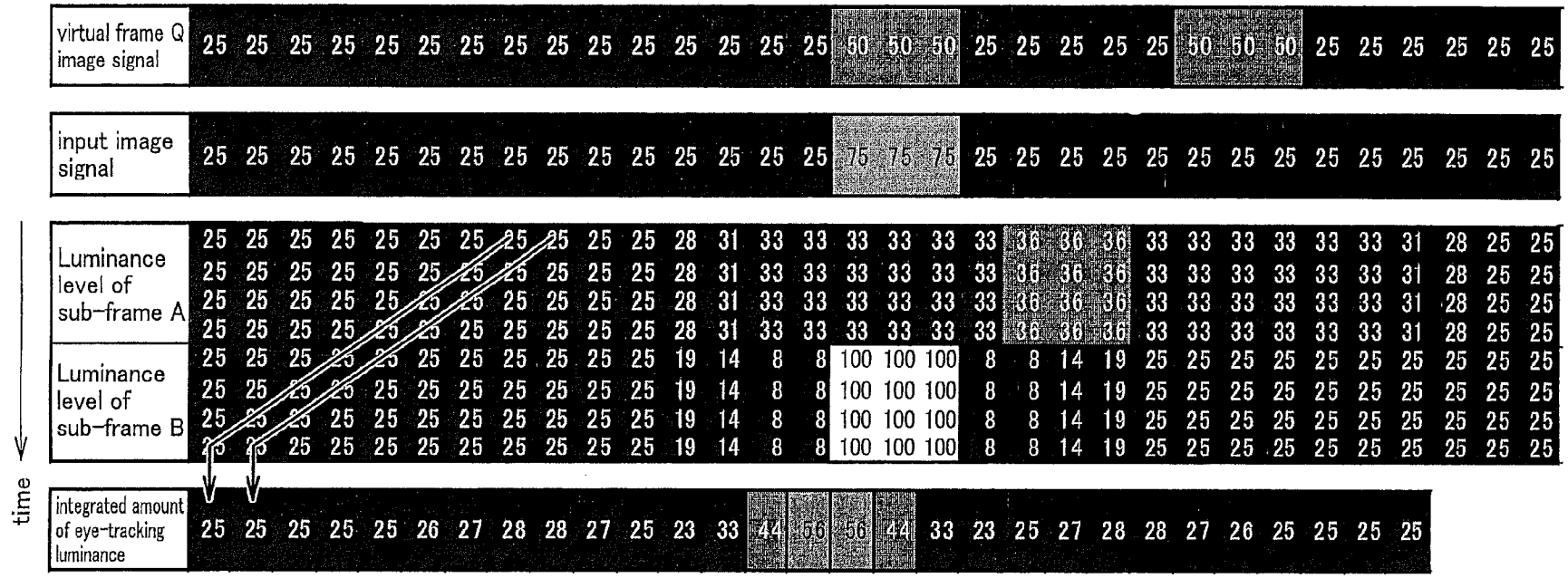
FIG. 27 A drawing showing numerical values indicating condition of luminance level for each pixel in 1 frame period.
Figure 28:
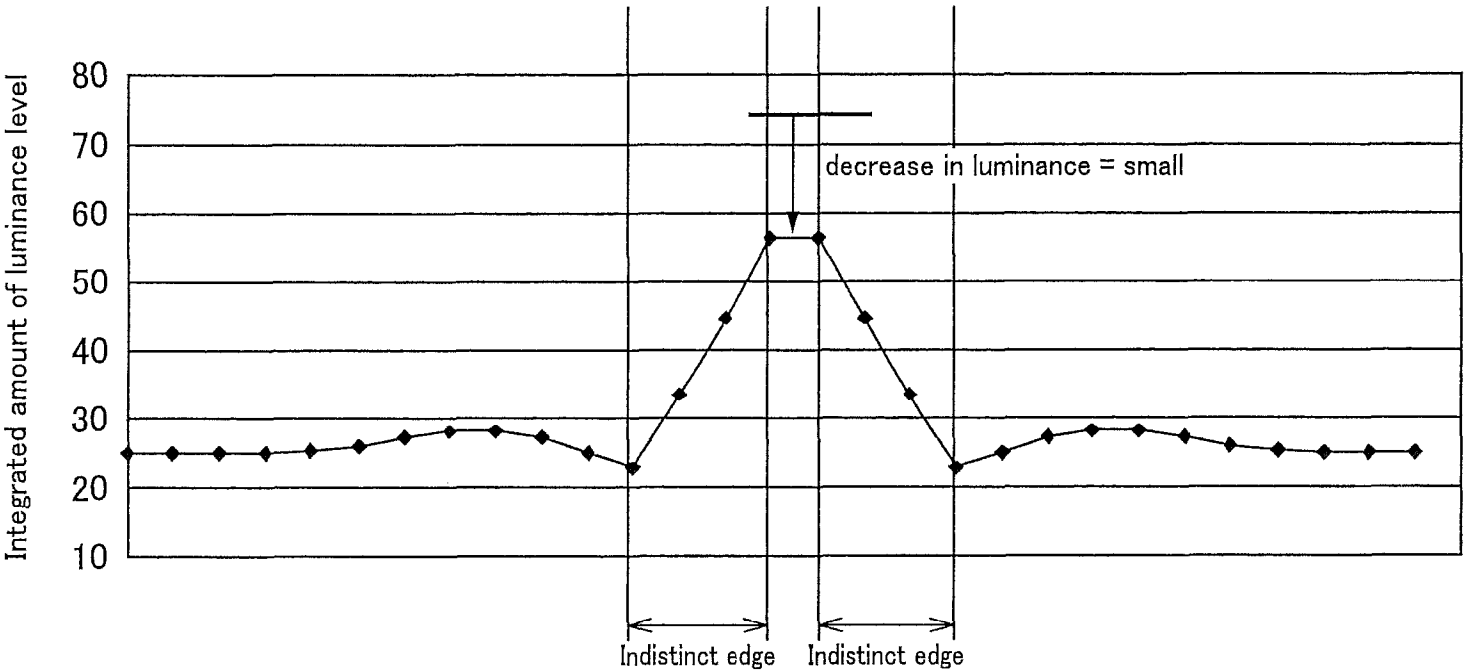
FIG. 28 A drawing showing visible luminance level distribution for an observer following a moving object.

FIG. 27 shows numerical values denoting the condition of luminance levels in the respective pixels in 1 frame period with respect to the virtual sub-frame Q and the input image signal, and FIG. 28 shows visible luminance level distribution for an observer following a moving object.

Figure 38:
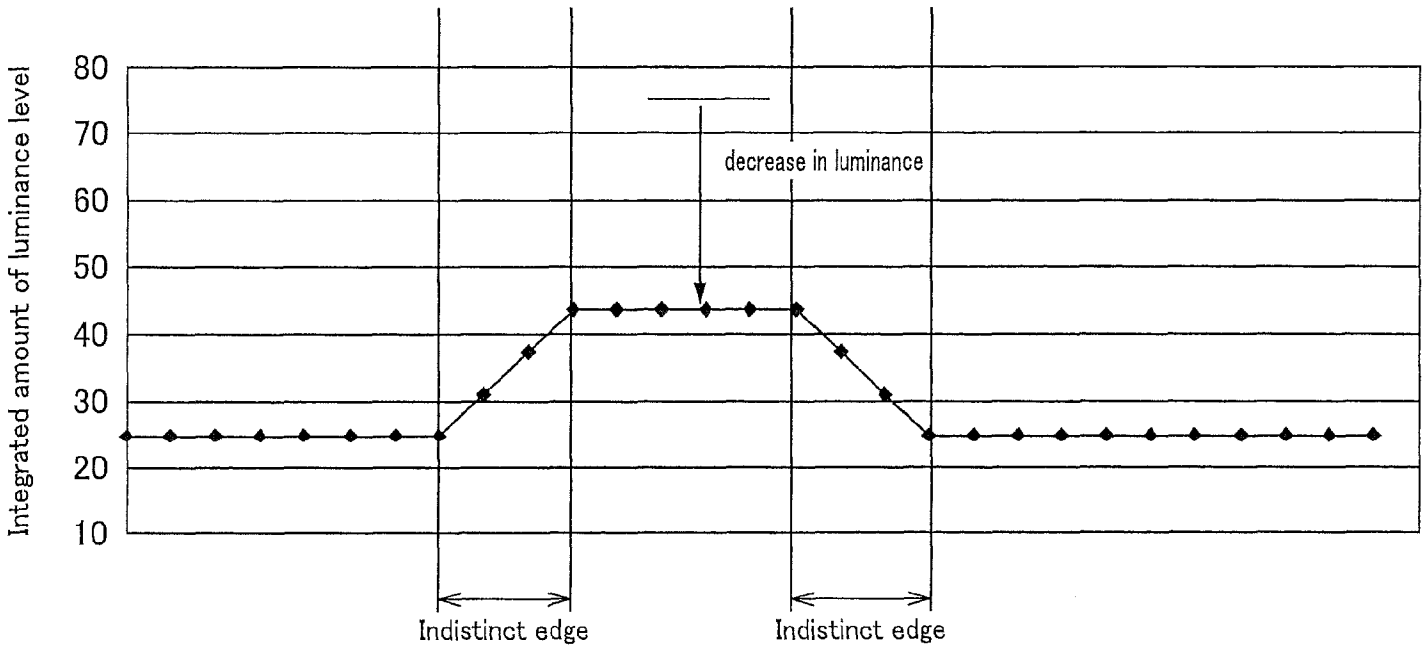
FIG. 38 A drawing showing visible luminance level distribution for an observer following a moving object.
Figure 39:
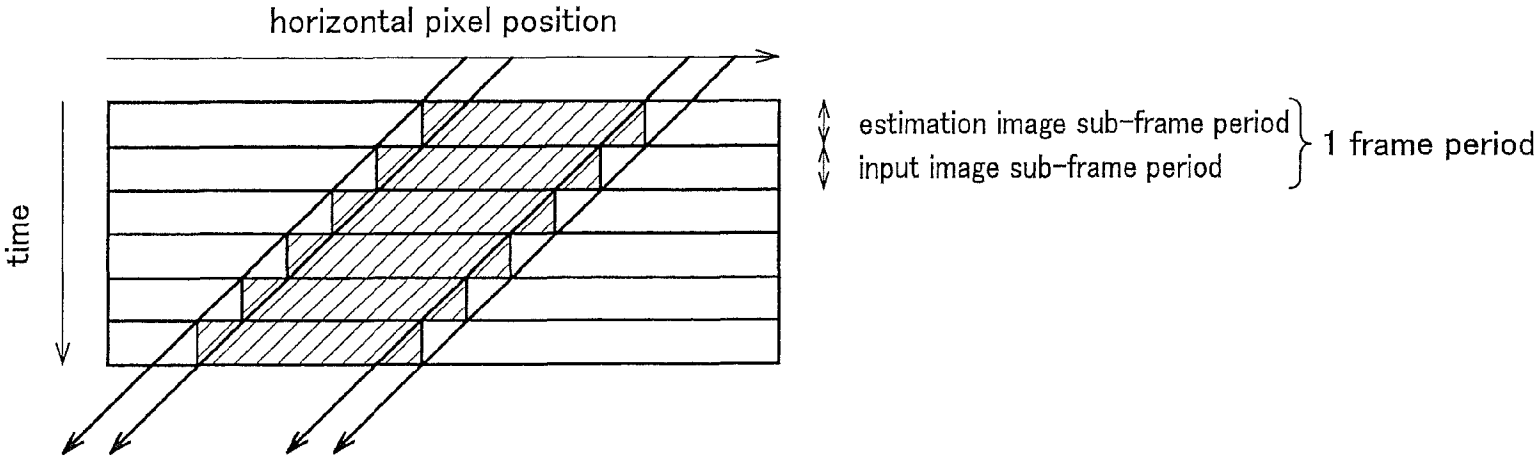
FIG. 39 A drawing showing a time transition of a display luminance distribution in the movement of an image in the horizontal direction.
Figure 41:
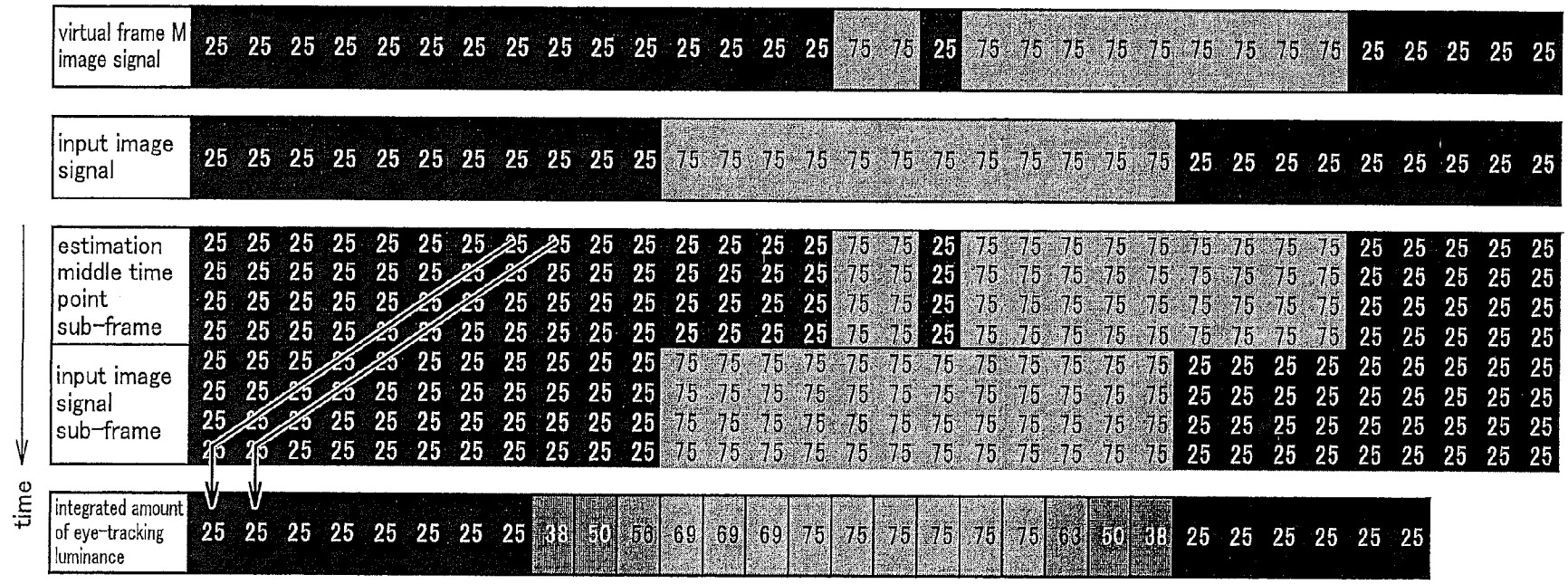
FIG. 41 A drawing showing numerical values indicating condition of luminance level for each pixel in 1 frame period.

Compared to the conventional structure of FIG. 38, the decrease in luminance level id reduced. In FIG. 28, compared to FIG. 16 regarding First Embodiment, it can be seen in the figure that the shape of the luminance distribution in the vicinity of the two horizontal edges of the moving object is symmetrical. That is to say, by equalizing the change in luminance level in the vicinity of the boundary of the two display luminances regardless of the moving direction, it is possible to reduce visible discomfort of the observer.

In addition to the foregoing structure, the image displaying method and image displaying apparatus according to the present invention are arranged so that the image signal $\alpha A$ becomes closer to the image signal $\beta$ as it comes closer to a boundary of the two regions, and becomes closer to the image signal $\alpha$ as it becomes more distant from the boundary of the two regions. In addition to the foregoing structure, the image displaying method and image displaying apparatus according to the present invention are arranged so that the image signal $\alpha B$ becomes less than the image signal $\alpha$ as it comes closer to the boundary of the two regions, and becomes closer to the image signal $\alpha$ as it becomes more distant from the boundary of the two regions. In addition to the foregoing structure, the image displaying method and image displaying apparatus according to the present invention are arranged so that the image signal $\beta A$ becomes closer to the image signal $\alpha$ as it comes closer to a boundary of the two regions, and becomes closer to the image signal $\beta$ as it becomes more distant from the boundary of the two regions. In addition to the foregoing structure, the image displaying method and image displaying apparatus according to the present invention are arranged so that the image signal $\beta B$ becomes greater than the image signal $\beta$ as it comes closer to the boundary of the two regions, and becomes closer to the image signal $\beta$ as it becomes more distant from the boundary of the two regions.

With these values, the difference among image signals in the vicinity of the boundary between the adjacent regions becomes smaller in the sub-frame A period, and becomes more significant in the sub-frame B period. Therefore, in addition to the foregoing effect, the moving picture quality can be improved more effectively.

Further, in addition to the foregoing structure, the image displaying method and image displaying apparatus according to the present invention are arranged so that the image signals $\alpha A$ and the $\beta A$ satisfy a relation: $\alpha A \leq \beta A$.

With this structure, the magnitude correlation among the image signals will not be reversed after the modification. Therefore, in addition to the foregoing effect, the moving picture quality can be improved more effectively.

In addition to the foregoing structure, the image displaying method and image displaying apparatus according to the present invention are arranged so that 1 frame period is divided into two periods: a sub-frame A period and a sub-frame B period.

In addition to the foregoing structure, the image displaying method and image displaying apparatus according to the present invention are arranged so that 1 frame period is divided into three periods including at least one sub-frame A period and at least one sub-frame B period.

In order to solve the foregoing problems, the image displaying method and image displaying apparatus according to the present invention is an image displaying apparatus for displaying an image based on an image signal in each pixel for each frame period corresponding to the image signal of a picture, the image displaying apparatus comprising: a display control section for dividing 1 frame into plural sub-frame periods including at least one sub-frame A period and at least one sub-frame B period, and for modifying an image signal of a target pixel in such a manner that, in the sub-frames period A, the difference between an image signal level of the target pixel and an image signal level in a reference range of pixels which reside, in a display picture, in the vicinity of the target pixel becomes smaller, and in the sub-frames period B, the difference between the image signal level of the target pixel and the image signal level in the reference range is emphasized.

With this structure, the display control section for divides 1 frame into plural sub-frame periods including at least one sub-frame A period and at least one sub-frame B period, and modifies an image signal of a target pixel in such a manner that, in the sub-frames period A, the difference between an image signal level of the target pixel and an image signal level in a reference range of pixels which reside, in a display picture, in the vicinity of the target pixel becomes smaller, and in the sub-frames period B, the difference between the image signal level of the target pixel and the image signal level in the reference range is emphasized. In this way, the present invention provides an effect of improvement in moving picture quality of a hold-type display device without causing a decrease in luminance or flicker.

Further, in addition to the foregoing structure, the image displaying apparatus according to the present invention is arranged so that the display control section determines an image signal for each pixel in the sub-frame A period and in the sub-frame B period so that a time integrated amount of luminance level of pixels in 1 frame period coincides with a luminance level of an input image signal of the target pixel.

With this structure, the display control section determines an image signal for each pixel in the sub-frame A period and in the sub-frame B period so that a time integrated amount of luminance level of pixels in 1 frame period coincides with a luminance level of an input image signal of the target pixel. In this way, the present invention provides an effect of assurance of image display with an appropriate luminance for an input image signal.

Further, in addition to the foregoing structure, the image displaying apparatus according to the present invention is arranged so that the display control section uses a mean signal level of signal levels of input image signals supplied to the pixels in the reference range as an image signal level for each pixel in the sub-frame A period.

With this structure, the display control section uses a mean signal level of signal levels of input image signals supplied to the pixels in the reference range as an image signal level for each pixel in the sub-frame A period. Therefore, in addition to the foregoing effect, the moving picture quality can be improved more effectively.

Further, in addition to the foregoing structure, the image displaying apparatus according to the present invention is arranged so that the display control section carries out image signal estimation so as to generate a virtual sub-frame M whose image signal level corresponds to a middle time point of two subsequent input frames, and uses a mean value of signal levels of input image signals supplied to the pixels in a reference range in the virtual sub-frame M as an image signal level for each pixel in the sub-frame A period.

With this structure, the display control section uses a mean value of signal levels of input image signals supplied to the pixels in a reference range in the virtual sub-frame M as an image signal level for each pixel in the sub-frame A period. Therefore, compared to the conventional method for carrying out display by insertion of a middle time point virtual sub-frame, it is possible to suppress degradation in picture quality even in the case of estimation error.

Further, in addition to the foregoing structure, the image displaying apparatus according to the present invention is arranged so that the display control section carries out calculation of image signals so as to generate a virtual sub-frame Q whose image signal level corresponds to a mean value of image signal levels of pixels of two subsequent input frames, and uses a mean value of signal levels of input image signals supplied to the pixels in a reference range in the virtual sub-frame Q as an image signal level for each pixel in the sub-frame A period.

With this structure, the display control section carries out calculation of image signals so as to generate a virtual sub-frame Q whose image signal level corresponds to a mean value of image signal levels of pixels of two subsequent input frames, and uses a mean value of signal levels of input image signals supplied to the pixels in a reference range in the virtual sub-frame Q as an image signal level for each pixel in the sub-frame A period. That is to say, by equalizing the change in luminance level in the vicinity of the boundary of the two display luminances regardless of the moving direction, it is possible to reduce visible discomfort of the observer, in addition to the foregoing effect.

Further, in addition to the foregoing structure, the image displaying apparatus according to the present invention is arranged so that the display control section determines an image signal level for each pixel in the sub-frame B period so that the difference between the image signal level of the target pixel and a mean image signal level of the image signal levels of input image signals supplied to the pixels in the reference range is emphasized.

With this structure, the display control section determines an image signal level for each pixel in the sub-frame B period so that the difference between the image signal level of the target pixel and a mean image signal level of the image signal levels of input image signals supplied to the pixels in the reference range is emphasized. Therefore, in addition to the foregoing effect, the moving picture quality can be improved more effectively.

Further, in addition to the foregoing structure, the image displaying apparatus according to the present invention is arranged so that an image signal level Lb of the target pixel in the sub-frame period B is set according to a condition: $Lb=2\times Ls-La$, where Ls expresses an input image signal level with respect to the target pixel, and La expresses a mean image signal level of the signal levels of input image signals supplied to the pixels in the reference range.

With this structure, an image signal level Lb of the target pixel in the sub-frame period B is set according to a condition: $Lb=2\times Ls-La$, where Ls expresses an input image signal level with respect to the target pixel, and La expresses a mean image signal level of the signal levels of input image signals supplied to the pixels in the reference range. Therefore, in addition to the foregoing effect, the moving picture quality can be improved more effectively.

Further, in addition to the foregoing structure, the image displaying apparatus according to the present invention is arranged so that the image signal level is a gradation level.

With this structure, the image signal level is a gradation level. Therefore, in addition to the foregoing effect, it is possible to reduce production cost.

Further, in addition to the foregoing structure, the image displaying apparatus according to the present invention is arranged so that the image signal level is a luminance level.

With this structure, the image signal level is a luminance level. Therefore, in addition to the foregoing effect, the moving picture quality can be improved more effectively.

Further, in addition to the foregoing structure, the image displaying apparatus according to the present invention is arranged so that the reference range includes a pixel to be modified.

Further, in addition to the foregoing structure, the image displaying apparatus according to the present invention is arranged so that the reference range is a part or the entire of 1 horizontal line including the target pixel which resides in the center.

With this structure, the reference range is a part or the entire of 1 horizontal line including the target pixel which resides in the center. Therefore, modification can be performed by reading only a single line memory. Therefore, in addition to the foregoing effect, it is possible to reduce production cost.

Further, in addition to the foregoing structure, the image displaying apparatus according to the present invention is arranged so that the reference range is a circular region including the target pixel which resides in the center.

With this structure, the reference range is a circular region including the target pixel which resides in the center. Therefore, in addition to the foregoing effect, it is possible to equalize the effects of improvement in moving picture quality in the movements in various directions.

Further, in addition to the foregoing structure, the image displaying apparatus according to the present invention is arranged so that the reference range is an ellipsoidal region including the target pixel which resides in the center.

With this structure, the reference range is an ellipsoidal region including the target pixel which resides in the center. Therefore, in addition to the foregoing effect, it is possible to equalize the effects of improvement in moving picture quality in the movements in various directions. Also, with this structure the present invention becomes suitable for a general video picture of TV broadcast or movies including more horizontal movements than the vertical movements, and many fast movements.

Further, in addition to the foregoing structure, the image displaying apparatus according to the present invention is arranged so that the reference range is a polygonal region including the target pixel which resides in the center.

With this structure, the reference range is an ellipsoidal region including the target pixel which resides in the center. Therefore, in addition to the foregoing effect, it is possible to equalize the effects of improvement in moving picture quality in the movements in various directions. Also, this structure can be realized by a calculation circuit of a simpler structure than that used in referring to the circular or ellipsoidal range. Therefore, it is possible to reduce production cost.

Further, in addition to the foregoing structure, the image displaying apparatus according to the present invention is arranged so that the reference range is a rectangular region including the target pixel which resides in the center.

With this structure, the reference range is an ellipsoidal region including the target pixel which resides in the center. Therefore, in addition to the foregoing effect, it is possible to equalize the effects of improvement in moving picture quality in the movements in various directions. Also, this structure can be realized by a calculation circuit of a simpler structure than that used in referring to a range of circular, ellipsoidal, or polygon other than rectangle. Therefore, it is possible to reduce production cost.

Further, in addition to the foregoing structure, the image displaying apparatus according to the present invention is arranged so that the reference range is equal to or more than 1% in size of a display screen either or both in a vertical direction or in a horizontal direction.

With this structure, the reference range is equal to or more than 1% in size of a display screen either or both in a vertical direction or in a horizontal direction. Therefore, in addition to the foregoing effect, it is possible to obtain a certain effect without significantly increase the data amount for calculation.

Further, in addition to the foregoing structure, the image displaying apparatus according to the present invention is arranged so that the reference range has a horizontal length longer than a vertical length.

With this structure, the reference range has a horizontal length longer than a vertical length. Therefore, the present invention is suitable for a general picture of TV broadcast or the like including many horizontal movements, and gives an effect of improving a moving picture quality.

Further, in addition to the foregoing structure, the image displaying apparatus according to the present invention is arranged so that there is only one sub-frame A period and only one sub-frame B period, and the sub-frame A period comes before the sub-frame B period.

With this structure, there is only one sub-frame A period and only one sub-frame B period, and the sub-frame A period comes before the sub-frame B period. Therefore, in addition to the foregoing effect, the moving picture quality can be improved more effectively.

Further, in addition to the foregoing structure, the image displaying apparatus according to the present invention is arranged so that there is only one sub-frame A period and only one sub-frame B period, and the sub-frame A period comes after the sub-frame B period.

With this structure, there is only one sub-frame A period and only one sub-frame B period, and the sub-frame A period comes after the sub-frame B period. Therefore, in addition to the foregoing effect, the moving picture quality can be improved more effectively.

Further, in addition to the foregoing structure, the image displaying apparatus according to the present invention is arranged so that there are two sub-frame A periods and only one sub-frame B period, and first and final sub-frame periods in 1 frame period are the sub-frame A period and a sub-frame period including a middle time point of an entire frame period is the sub-frame B period.

With this structure, there are two sub-frame A periods and only one sub-frame B period, and first and final sub-frame periods in 1 frame period are the sub-frame A period and a sub-frame period including a middle time point of an entire frame period is the sub-frame B period. That is to say, by equalizing the change in luminance level in the vicinity of the boundary of the two display luminances regardless of the moving direction, it is possible to reduce visible discomfort of the observer, in addition to the foregoing effect.

Further, in addition to the foregoing structure, the image displaying apparatus according to the present invention serves as a liquid crystal television image-receiver, and further comprises: an image-receiving section for receiving television broadcast and supplying video signals denoting images transmitted via the television broadcast to the display control section; and an image display section constituted of a liquid crystal panel for displaying images based on image signals sent from the display control section according to the video signals.

Further, in addition to the foregoing structure, the image displaying apparatus and method according to the present invention are arranged so that the condition: $\alpha A>\alpha$ is satisfied in the case where a width of a narrowest part of the region supplied with an image signal $\alpha$ is equal to or less than 1% of either of a horizontal length or a vertical length of a display screen in which the image displaying is performed.

Further, in addition to the foregoing structure, the image displaying apparatus and method according to the present invention are arranged so that the condition: $\alpha B>\alpha$ is satisfied in the case where a width of a narrowest part of the region supplied with an image signal $\alpha$ is equal to or less than 1% of either of a horizontal length or a vertical length of a display screen in which the image displaying is performed.

Further, in addition to the foregoing structure, the image displaying apparatus and method according to the present invention are arranged so that the condition: $\beta A>\beta$ is satisfied in the case where a width of a narrowest part of the region supplied with an image signal $\alpha$ is equal to or less than 1% of either of a horizontal length or a vertical length of a display screen in which the image displaying is performed.

Further, in addition to the foregoing structure, the image displaying apparatus and method according to the present invention are arranged so that the condition: $\beta B>\beta$ is satisfied in the case where a width of a narrowest part of the region supplied with an image signal $\alpha$ is equal to or less than 1% of either of a horizontal length or a vertical length of a display screen in which the image displaying is performed.

With this structure, it is possible to reduce a decrease in visible luminance in the region of luminance $\beta$ when the observer follows the luminance $\beta$ region of the input image signal narrower than the transition amount of 1 frame period moving on the background of luminance $\alpha$ of the input image signal. On the other hand, it is possible to reduce an increase in visible luminance in the region of luminance $\alpha$ when the observer follows the luminance $\alpha$ region of the input image signal narrower than the transition amount of 1 frame period moving on the background of luminance $\beta$ of the input image signal.

As described, the image displaying method and image displaying apparatus according to the present invention is an image displaying method for displaying an image in each pixel for each frame period corresponding to image signals of 1 display image, based on the image signals, wherein: 1 frame is divided into plural sub-frame periods including at least one sub-frame A period and at least one sub-frame B period, and the following condition is satisfied on input of an image of a frame in which a region supplied with an image signal $\alpha$ and a region supplied with an image signal $\beta$ satisfying $\alpha<\beta$ are adjacent to each other, $\alpha\leq\alpha A<\beta$, $\alpha B\leq\alpha$, where $\alpha A$ expresses an image signal for image output in the sub-frame A period and $\alpha B$ expresses an image signal for image output in the sub-frame B period, in each pixel in the region supplied with an image signal $\alpha$, $\alpha<\beta A\leq\beta$, $\beta\leq\beta B$, where $\beta A$ expresses an image signal for image output in the sub-frame A period and $\beta B$ expresses an image signal for image output in the sub-frame B period, in each pixel in the region supplied with an image signal $\beta$, and, on condition that $D=\beta-\alpha$, $DA=|\beta A-\alpha A|$, $DB=|\beta B-\alpha B|$, the following condition is satisfied, $$DA\leq D, D\leq DB, \text{ and } DA<DB.$$

Further, an image displaying apparatus according to the present invention is An image displaying method for displaying an image in each pixel for each frame period corresponding to image signals of 1 display image, based on the image signals, the image displaying apparatus comprising: a display control section for dividing 1 frame into plural sub-frame periods including at least one sub-frame A period and at least one sub-frame B period, and for modifying an image signal of a target pixel in such a manner that, in the sub-frames period A, the difference between an image signal level of the target pixel and an image signal level in a reference range of pixels which reside, in a display picture, in the vicinity of the target pixel becomes smaller, and in the sub-frames period B, the difference between the image signal level of the target pixel and the image signal level in the reference range is emphasized.

In this way, the present invention provides an effect of improvement in moving picture quality of a hold-type display device without causing a decrease in luminance or flicker.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

INDUSTRIAL APPLICABILITY

The present invention is applicable to an image displaying apparatus using a hold-type display apparatus, such as a liquid crystal display apparatus.

What is claimed is:

1. An image displaying apparatus for displaying an image corresponding to an input image signal, the image displaying apparatus comprising:

a display control section to divide one frame into plural sub-frame periods including at least one sub-frame period A and at least one sub-frame period B, and to modify an image signal level of an input image signal of a target pixel such that an image signal level of the target pixel always has an image signal level greater than or equal to the image signal level of the image signal supplied in the at least one sub-frame period A or B and always has an image signal level less than or equal to the image signal level of the image signal supplied in the other one of the at least one sub-frame period A or B, wherein, in the sub-frame period A or B, a difference between an image signal level of the target pixel and an image signal level in a reference range of pixels in the vicinity of the target pixel, is either increased or decreased, and in the other of sub-frame period A or B, the difference between the image signal level of the target pixel and the image signal level in the reference range is the other of increased or decreased.

2. The image displaying apparatus as set forth in claim 1, wherein the display control section is configured to determine an image signal for each pixel in the sub-frame period A and in the sub-frame period B so that a time integrated amount of luminance level of pixels in one frame period coincides with a luminance level of an input image signal of the target pixel.

3. The image displaying apparatus as set forth in claim 1, wherein the display control section is adapted to use a mean signal level of signal levels of input image signals supplied to the pixels in the reference range as an image signal level for each pixel in the sub-frame period A.

4. The image displaying apparatus as set forth in claim 1, wherein the display control section is adapted to carry out image signal estimation so as to generate a virtual sub-frame M, whose image signal level corresponds to a middle time point of two subsequent input frames, and to use a mean value of signal levels of input image signals supplied to the pixels in a reference range in the virtual sub-frame M as an image signal level for each pixel in the sub-frame period A.

5. The image displaying apparatus as set forth in claim 1, wherein the display control section is adapted to carry out calculation of image signals so as to generate a virtual sub-frame Q whose image signal level corresponds to a mean value of image signal levels of pixels of two subsequent input frames, and to use a mean value of signal levels of input image signals supplied to the pixels in a reference range in the virtual sub-frame Q as an image signal level for each pixel in the sub-frame period A.

6. The image displaying apparatus as set forth in claim 1, wherein the display control section is adapted to determine an image signal level for each pixel in the sub-frame period B so that the difference between the image signal level of the target pixel and a mean image signal level of the image signal levels of input image signals supplied to the pixels in the reference range is emphasized.

7. The image displaying apparatus as set forth in claim 1, wherein an image signal level Lb of the target pixel in the sub-frame period B is set according to a condition: $Lb=2\times Ls-La$, where Ls expresses an input image signal level with respect to the target pixel, and La expresses a mean image signal level of the signal levels of input image signals supplied to the pixels in the reference range.

8. The image displaying apparatus as set forth in claim 1, wherein the image signal level is a gradation level.

9. The image displaying apparatus as set forth in claim 1, wherein the image signal level is a luminance level.

10. The image displaying apparatus as set forth in claim 1, wherein the reference range includes a pixel to be modified.

11. The image displaying apparatus as set forth in claim 1, wherein the reference range is at least a part of one horizontal line including the target pixel which resides in the center.

12. The image displaying apparatus as set forth in claim 1, wherein the reference range is a circular region including the target pixel which resides in the center.

13. The image displaying apparatus as set forth in claim 1, wherein the reference range is a ellipsoidal region including the target pixel which resides in the center.

14. The image displaying apparatus as set forth in claim 1, wherein the reference range is a polygonal region including the target pixel which resides in the center.

15. The image displaying apparatus as set forth in claim 1, wherein the reference range is a rectangular region including the target pixel which resides in the center.

16. The image displaying apparatus as set forth in claim 1, wherein the reference range is at least one of equal and more than 1% in size of a display screen, in at least one of a vertical direction and in a horizontal direction.

17. The image displaying apparatus as set forth in claim 1, wherein the reference range has a horizontal length longer than a vertical length.

18. The image displaying apparatus as set forth in claim 2, wherein there is only one sub-frame period A and only one sub-frame period B, and the sub-frame period A comes before the sub-frame period B.

19. The image displaying apparatus as set forth in claim 1, wherein there is only one sub-frame period A and only one sub-frame period B, and the sub-frame period A comes after the sub-frame period B.

20. The image displaying apparatus as set forth in claim 1, wherein there are two sub-frame periods A and only one sub-frame period B, and first and final sub-frame periods in one frame period are the sub-frame period A and a sub-frame period including a middle time point of an entire frame period is the sub-frame period B.

21. The image displaying apparatus as set forth in claim 1, wherein a single frame period is divided into two frame periods: the sub-frame period A and the sub-frame period B.

22. The image displaying apparatus as set forth in claim 1, wherein one frame period is divided into three periods including at least one sub-frame period A and at least one sub-frame period B.

23. A liquid crystal television image-receiver comprising the image displaying apparatus as set forth in claim 1, the liquid crystal television image-receiver further comprising:

an image-receiving section to receive television broadcast and to supply video signals denoting images transmitted via the television broadcast to the display control section; and a liquid crystal panel to display images based on image signals sent from the display control section according to the video signals.

* * * * *